US008002374B2

(12) United States Patent
Imanaka et al.

(10) Patent No.: US 8,002,374 B2
(45) Date of Patent: Aug. 23, 2011

(54) PRINTHEAD DRIVING METHOD, PRINTHEAD SUBSTRATE, PRINTHEAD, HEAD CARTRIDGE, AND PRINTING APPARATUS

(75) Inventors: Yoshiyuki Imanaka, Kawasaki (JP); Nobuyuki Hirayama, Fujisawa (JP); Ichiro Saito, Yokohama (JP); Muga Mochizuki, Yokohama (JP); Takaaki Yamaguchi, Yokohama (JP); Masao Kato, Kawasaki (JP); Toshiyasu Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 882 days.

(21) Appl. No.: 11/865,306

(22) Filed: Oct. 1, 2007

(65) Prior Publication Data

US 2008/0024534 A1 Jan. 31, 2008

Related U.S. Application Data

(62) Division of application No. 10/980,192, filed on Nov. 4, 2004, now Pat. No. 7,344,218.

(30) Foreign Application Priority Data

Nov. 6, 2003 (JP) ..... 2003-377259
Nov. 6, 2003 (JP) ..... 2003-377261

(51) Int. Cl.
*B41J 29/38* (2006.01)

(52) U.S. Cl. ..... 347/10; 347/9; 347/14; 347/19

(58) Field of Classification Search ..... 347/9, 14, 347/10

See application file for complete search history.

(56) References Cited

U.S. PATENT DOCUMENTS 4,313,124 A 1/1982 Hara
4,345,262 A 8/1982 Shirato et al.
4,429,321 A 1/1984 Matsumoto
4,459,600 A 7/1984 Sato et al.
4,463,359 A 7/1984 Ayata et al.

(Continued)

FOREIGN PATENT DOCUMENTS

EP 0 737 586 10/1996

(Continued)

OTHER PUBLICATIONS

Patent Abstracts of Japan, vol. 2000, No. 24, May 11, 2001 (JP 2001-191531, Jul. 17, 2001).

(Continued)

*Primary Examiner* — Matthew Luu
*Assistant Examiner* — Brian J Goldberg
(74) *Attorney, Agent, or Firm* — Fitzpatrick, Cella, Harper & Scinto

(57) ABSTRACT

An increase in energy applied to a heating element can be prevented and the service life of a printhead can be prolonged even when the temperature of the printing element having a negative temperature coefficient rises and the resistance of the heating element decreases. A printhead having heating elements connected to a common power supply comprises a switching element series-connected to and controlling driving of the heating element at a voltage applied to a control terminal; a constant voltage source; a wiring resistance generated at a connection wiring line serial-connected to the heating element; and a voltage control circuit which controls to make the potential difference between both ends of the wiring resistance equal to the voltage of the constant voltage source when driving the heating element. A current flowing through the heating element is made constant without any influence of the temperature.

4 Claims, 19 Drawing Sheets

U.S. PATENT DOCUMENTS

| | | | | |
|---|---|---|---|---|
| 4,558,333 | A | 12/1985 | Sugitani et al. | |
| 4,709,243 | A | 11/1987 | Kato et al. | |
| 4,723,129 | A | 2/1988 | Endo et al. | |
| 4,740,796 | A | 4/1988 | Endo et al. | |
| 5,767,872 | A * | 6/1998 | Scardovi et al. | 347/17 |
| 5,809,214 | A | 9/1998 | Nureki et al. | |
| 5,841,448 | A | 11/1998 | Moriyama et al. | |
| 5,943,070 | A | 8/1999 | Kamiyama et al. | |
| 6,003,973 | A | 12/1999 | Kamiyama et al. | |
| 6,054,689 | A | 4/2000 | Imanaka et al. | |
| 6,074,041 | A | 6/2000 | Imanaka et al. | |
| 6,097,208 | A | 8/2000 | Okajima et al. | |
| 6,116,714 | A | 9/2000 | Imanaka et al. | |
| 6,130,692 | A | 10/2000 | Mochizuki et al. | |
| 6,224,184 | B1 | 5/2001 | Imanaka et al. | |
| 6,224,195 | B1 | 5/2001 | Maru et al. | |
| 6,252,616 | B1 | 6/2001 | Okazaki et al. | |
| 6,293,655 | B1 | 9/2001 | Imanaka et al. | |
| 6,302,504 | B1 | 10/2001 | Imanaka et al. | |
| 6,315,853 | B1 | 11/2001 | Kubota et al. | |
| 6,382,756 | B1 | 5/2002 | Komuro | |
| 6,402,302 | B1 | 6/2002 | Ozaki et al. | |
| 6,439,680 | B1 | 8/2002 | Mochizuki et al. | |
| 6,443,563 | B1 | 9/2002 | Saito et al. | |
| 6,450,617 | B1 | 9/2002 | Kitani et al. | |
| 6,454,379 | B1 | 9/2002 | Taneya et al. | |
| 6,467,863 | B1 | 10/2002 | Imanaka et al. | |
| 6,474,769 | B1 | 11/2002 | Imanaka et al. | |
| 6,513,911 | B1 | 2/2003 | Ozaki et al. | |
| 6,520,613 | B1 | 2/2003 | Tamura | |
| 6,523,922 | B2 * | 2/2003 | Hirayama | 347/9 |
| 6,540,316 | B1 | 4/2003 | Imanaka et al. | |
| 6,578,951 | B2 | 6/2003 | Ozaki et al. | |
| 6,609,783 | B1 | 8/2003 | Koyama et al. | |
| 6,634,736 | B2 | 10/2003 | Miyakoshi et al. | |
| 6,653,748 | B2 | 11/2003 | Buchanan | |
| 6,688,729 | B1 | 2/2004 | Imanaka et al. | |
| 6,712,437 | B2 | 3/2004 | Furukawa et al. | |
| 6,773,096 | B2 | 8/2004 | Mochizuki et al. | |
| 6,824,237 | B2 | 11/2004 | Hirayama et al. | |
| 6,890,048 | B2 | 5/2005 | Hirayama | |
| 7,216,960 | B2 | 5/2007 | Imanaka et al. | |
| 2002/0036781 | A1 | 3/2002 | Hirayama | |
| 2003/0090533 | A1 | 5/2003 | Imanaka et al. | |
| 2003/0142153 | A1 | 7/2003 | Nakajima et al. | |
| 2004/0012654 | A1 | 1/2004 | Takeuchi et al. | |
| 2005/0134620 | A1 | 6/2005 | Hirayama et al. | |

FOREIGN PATENT DOCUMENTS

| | | |
|---|---|---|
| EP | 0 816 082 | 1/1998 |
| JP | 54-51837 | 4/1979 |
| JP | 56-89578 | 7/1981 |
| JP | 59-95154 | 6/1984 |
| JP | 3-208654 | 9/1991 |
| JP | 9-226102 | 9/1997 |
| JP | 9-300620 | 11/1997 |
| JP | 10-105306 | 4/1998 |
| JP | 2001-277516 | 10/2001 |
| JP | 2002-19117 | 1/2002 |
| KR | 10-0238857 | 1/2000 |
| KR | 10-0398032 | 3/2004 |

OTHER PUBLICATIONS

Patent Abstracts of Japan, vol. 1998, No. 10, Aug. 31, 1998 (JP 10-138484, May 26, 1998).

* cited by examiner

FIG. 9

LOSSES OTHER THAN THOSE OF HEATING ELEMENT AND DRIVER ARE CONTAINED IN 1 V OF DRIVER LOSS AND THE LIKE.

| HEATING ELEMENT RESISTANCE | VOLTAGE BETWEEN BOTH ENDS OF HEATING ELEMENT | CURRENT FOR CONSTANT VOLTAGE BETWEEN BOTH ENDS OF HEATING ELEMENT | POWER APPLIED TO HEATING ELEMENT UNDER CONDITIONS DESCRIBED LEFT | POWER LOSS FOR 16 V POWER SUPPLY | POWER LOSS RATIO (TO POWER APPLIED TO HEATING ELEMENT) | PULSE WIDTH Pw FOR CONSTANT ENERGY | ENERGY APPLIED TO HEATING ELEMENT | ENERGY LOSS | MAXIMUM DRIVING FOP IN 32 DIVISION |
|---|---|---|---|---|---|---|---|---|---|
| Ω | V | A | W | W | | μS | μJ | μJ | |
| 80 | 15.0 | 0.188 | 2.813 | 0.188 | 0.067 | 0.80 | 2.25 | 0.150 | 39.1KHz |
| 90 | 15.0 | 0.167 | 2.500 | 0.167 | 0.067 | 0.90 | 2.25 | 0.150 | 34.7KHz |
| 100 | 15.0 | 0.150 | 2.250 | 0.150 | 0.067 | 1.00 | 2.25 | 0.150 | 31.3KHz |
| 110 | 15.0 | 0.136 | 2.045 | 0.136 | 0.067 | 1.10 | 2.25 | 0.150 | 28.4KHz |
| 120 | 15.0 | 0.125 | 1.875 | 0.125 | 0.067 | 1.20 | 2.25 | 0.150 | 26.0KHz |

REPRESENTING DIFFERENCE IN MAXIMUM DRIVING DISCHARGE FREQUENCY OBTAINED FROM TIME WHEN PULSE WIDTH IS MULTIPLIED 32 TIMES (IN 32 TIME DIVISION) OWING TO VARIATIONS IN RESISTANCE VALUE OF HEATING ELEMENT

FIG. 17

LOSSES OTHER THAN THOSE OF HEATING ELEMENT AND DRIVER ARE CONTAINED IN 1 V OF DRIVER LOSS.

| HEATING ELEMENT RESISTANCE | VOLTAGE BETWEEN BOTH ENDS OF HEATING ELEMENT FOR CONSTANT CURRENT | POWER $V^2/R$ APPLIED TO HEATING ELEMENT FOR CONSTANT CURRENT | POWER LOSS FOR 19 V POWER SUPPLY | POWER LOSS RATIO | PULSE WIDTH Pw FOR CONSTANT ENERGY | ENERGY APPLIED TO HEATING ELEMENT | ENERGY LOSS |
|---|---|---|---|---|---|---|---|
| Ω | V | W | W | | μS | μJ | μJ |
| 80 | 12.0 | 1.800 | 1.05 | 0.583 | 1.25 | 2.25 | 1.31 |
| 90 | 13.5 | 2.025 | 0.825 | 0.407 | 1.11 | 2.25 | 0.92 |
| 100 | 15.0 | 2.250 | 0.6 | 0.267 | 1.00 | 2.25 | 0.60 |
| 110 | 16.5 | 2.475 | 0.375 | 0.152 | 0.91 | 2.25 | 0.34 |
| 120 | 18.0 | 2.700 | 0.15 | 0.056 | 0.83 | 2.25 | 0.13 |

PRINTHEAD DRIVING METHOD, PRINTHEAD SUBSTRATE, PRINTHEAD, HEAD CARTRIDGE, AND PRINTING APPARATUS

This is a divisional application of application Ser. No. 10/980,192, filed Nov. 4, 2004.

FIELD OF THE INVENTION

This invention relates to a printhead driving method, printhead substrate, printhead, head cartridge, and printing apparatus and, more particularly, to a printhead driving method capable of making the driving conditions of a plurality of heating elements connected to a common power supply equal, suppressing variations in energy applied to a heating element that occur under various driving conditions in consideration of manufacturing variations in the resistance of the heating element, and performing high-quality printing, improve the durability of the printhead, as well as printing an image and the like by discharging ink onto a printing medium, printhead substrate, printhead, head cartridge, and printing apparatus.

BACKGROUND OF THE INVENTION

A printing apparatus having the function of a printer, copying machine, facsimile apparatus, or the like, or a printing apparatus used as an output device for a multifunction apparatus or workstation including a computer, word processor, or the like prints an image on a printing medium such as a printing sheet or thin plastic plate (used for an OHP sheet or the like) on the basis of image information.

Such printing apparatuses are classified by the printing method used into an inkjet type, wire dot type, thermal type, thermal transfer type, electrophotographic type, and the like.

Of these printing apparatuses, a printing apparatus of an inkjet type (to be referred to as an inkjet printing apparatus hereinafter) prints by discharging ink from a printhead onto a printing medium. The inkjet printing apparatus has many advantages: the apparatus can be easily downsized, print a high-resolution image at a high speed, and print on a plain sheet without requiring any special process. In addition, the running cost of the inkjet printing apparatus is low, and the inkjet printing apparatus hardly generates noise because of non-impact printing and can print a color image by using multicolor ink.

The inkjet printing method includes several methods, and one of the methods is a bubble-jet printing method in which a heater is mounted within a nozzle, bubbles are generated in ink by heat, and the foaming energy is used to discharge ink. A heating element which generates thermal energy for discharging ink can be manufactured by a semiconductor manufacturing process. Examples of a commercially available printhead utilizing the bubble-jet technique are (1) a printhead obtained by forming a heating element on a silicon substrate as a base to prepare a heating element substrate and joining to the element substrate a top plate which has a groove for forming an ink channel and is made of a resin (e.g., polysulfone), glass, or the like, and (2) a high-resolution printhead obtained by directly forming a nozzle on an element substrate by photolithography so as to eliminate any joint.

FIG. 13 is a circuit diagram showing an example of a heater driving circuit within a printhead mounted on an inkjet printing apparatus which prints by the bubble-jet printing method.

A heater (heating element) R1 formed on a printhead element substrate and a switching element Q1 for switching a current to the heater are series-connected between a power supply VH and ground. An arbitrary switching element is turned on/off in accordance with a control signal corresponding to printing information from the printing apparatus main body. Ink is discharged from a nozzle corresponding to the driven heater, forming an image.

In order to obtain a high-quality image in a printing apparatus having a printhead which discharges ink by utilizing thermal energy generated by the above-mentioned heater, the volume of each discharged ink droplet must always be stabilized at a constant value. For this purpose, it is considered desirable to keep the heat generation amount of the heater constant.

Letting V be the potential difference of the heater, R be the resistance value of the heater, and t be the voltage application time, a heat generation amount P of the heater which converts electric energy into thermal energy is given by $$P=(V^2/R)\cdot t \quad (1)$$

As is apparent from equation (1), the heat generation amount of the heater greatly changes depending on the resistance value of the heater and a voltage applied to the heater. The resistance value of the heater varies by about 20% owing to the manufacturing process of the heater. Several methods have been known as a method of suppressing the influence of such variations on the heat generation amount (see, e.g., U.S. Pat. Nos. 5,943,070 and 6,382,756).

According to the method disclosed in U.S. Pat. No. 5,943,070, the resistance value of a dummy heater which is formed in a printhead from the same material as that of a heater for ink discharge is measured, and the resistance value of the heater for ink discharge is calculated from the measured resistance value. The pulse width of a pulse signal to be supplied to the heater is adjusted in accordance with the calculated resistance value of the heater to optimize the heat generation amount of the heater.

According to the method disclosed in U.S. Pat. No. 6,382,756, the ON resistance of a switching element such as a MOS transistor which is series-connected to a heater also varies in the manufacture. The ON resistance of the MOS transistor is series-connected to the resistance of the heater between the power supply and ground. A voltage applied to the heater is a voltage divided at the ratio of the resistance of the heater to the ON resistance of the MOS transistor.

Hence, variations in the ON resistance of the MOS transistor are equivalent to changes in the term V of equation (1), and influence the heat generation amount of the heater. To suppress this influence, a dummy MOS transistor is formed in a printhead, similar to the method disclosed in U.S. Pat. No. 5,943,070. The ON resistance of the MOS transistor is measured, and the voltage V to be applied to the heater is calculated. By using the calculation result, the pulse width of a pulse to be supplied to the heater is so adjusted as to make the heat generation amount of the heater constant.

Under the above background, there has also been proposed to control a switching element so as to make the voltage between both ends of a heating element constant and supply a constant current to the heating element for the purpose of constant energy (see, e.g., U.S. Pat. No. 6,523,922).

Since the element substrate is made of a silicon substrate, not only a heating element is formed on an element substrate, but a driver for driving the heating element, a temperature sensor used to control the heating element in accordance with the temperature of the printhead, a driving controller for the driver, and the like may be formed on the element substrate.

FIG. 14 is a block diagram showing a representative example of the configuration of an element substrate for a conventional inkjet printhead (see U.S. Pat. No. 6,116,714).

As shown in FIG. 14, an element substrate 900 comprises a plurality of heating elements 901 which are parallel-arrayed and supply thermal energy for discharge to ink, power transistors (drivers) 902 which drive the heating elements 901, a shift register 904 which receives externally serially input image data and serial clocks synchronized with the image data, and receives image data for each line, a latch circuit 903 which latches image data of one line output from the shift register 904 in synchronism with a latch clock and parallel-transfers the image data to the power transistors 902, a plurality of AND gates 915 which are respectively arranged in correspondence with the power transistors 902 and supply output signals from the latch circuit 903 to the power transistors 902 in accordance with an external enable signal, and input terminals 905 to 912 which externally receive image data, various signals, and the like. Of these input terminals, the terminal 910 is a heating element driving GND terminal, and the terminal 911 is a heating element driving power supply terminal.

The element substrate 900 further comprises a sensor monitor 914 such as a temperature sensor for measuring the temperature of the element substrate 900, or a resistance monitor for measuring the resistance value of each heating element 901. A printhead in which a driver, a temperature sensor, a driving controller, and the like are integrated in an element substrate has already been commercially available, and contributes to improvement of the printhead reliability and downsizing of the apparatus.

In this configuration, image data input as serial signals are converted into parallel signals by the shift register 904, output to the latch circuit 903, and latched by it in synchronism with a latch clock. In this state, driving pulse signals for the heating elements 901 (enable signals for the AND gates 915) are input via an input terminal, and the power transistors 902 are turned on in accordance with the image data. A current then flows through corresponding heating elements 901, and ink in the liquid channels (nozzles) is heated and discharged as droplets from orifices at the distal ends of the nozzles.

FIG. 15 is a view showing in detail a part associated with variations in parasitic resistance on the element substrate for the inkjet printhead shown in FIG. 14.

A parasitic resistance (or constant voltage) component 916 which leads to a loss in supplying energy to the heating element upon application of a constant power supply voltage from the printing apparatus main body exists in the power transistor 902 (which is a bipolar transistor in this case, but may be a MOS transistor) shown in FIGS. 14 and 15, and a common power supply wiring line and GND wiring line for driving a plurality of heating elements. Further, in areas 2801 and 2802 encircled by broken lines as shown in FIG. 15, a voltage generated by the parasitic resistance 916 changes depending on the number of simultaneously driven heating elements 901, and as a result, energy applied to the heating element 901 varies.

The area 2801 contains a parasitic resistance component 2801*a* present in a power supply wiring line of the inkjet printing apparatus, a parasitic resistance component 2801*b* present in a power supply wiring line of the inkjet printhead, and a parasitic resistance component 2801*c* in a common power supply wiring line. Likewise, the area 2802 contains a parasitic resistance component 2802*a* present in a GND wiring line of the inkjet printing apparatus, a parasitic resistance component 2802*b* present in a GND wiring line of the inkjet printhead, and a parasitic resistance component 2802*c* in a common GND wiring line.

In practice, as shown in FIG. 15, the heating elements 901 serving as printing elements inevitably vary in absolute resistance value by ±20% to 30% in mass production owing to the difference in film thickness and its distribution in the substrate manufacturing process.

From this, a power transistor has been used as a driver for driving the heating element of an available inkjet printhead in order to mainly reduce the resistance. The power transistor 902 functions as a constant power supply having an opposite bias to a constant element driving power supply, or an ON resistance. Since a current flowing through the heating element 901 changes depending on variations in the resistance of the heating element, energy (power consumption) applied to the heating element during a predetermined time greatly changes depending on the resistance value of the heating element in the manufacture.

The energy change has conventionally been coped with by changing by the resistance of the heating element a pulse width applied to drive the heating element. With this measure, power consumption of the heating element is made constant so as to stably discharge ink by driving the inkjet printhead and achieve a long service life of the printhead.

In recent years, the number of necessary printing elements greatly rises for higher printing speed. At the same time, it becomes more necessary than a conventional printing apparatus to uniform energy applied to the heating element for higher printing resolution. As described above, as the difference in the number of simultaneously driven printing elements becomes larger, energy applied to the heating elements more greatly varies, and the service life of the printhead becomes shorter. This generates a fault such as degradation of the printing quality owing to energy variations.

As a recent technique, the driver part is so controlled as to supply a constant current to each heater in a configuration having an effect of making energy constant, as shown in FIG. 16. This configuration can solve the above-described problem because a constant current always flows through each heating element and energy, i.e., (resistance value of heating element)×(square of constant current value) is supplied regardless of the number of simultaneously driven printing elements unless the resistance value varies during use. A configuration which keeps a current flowing through the heating element constant has also been proposed (see, e.g., U.S. Pat. No. 6,523,922).

The heating element used for the printing element of the inkjet printhead is generally made of a material having a negative temperature coefficient (that is, the resistance of the heating element decreases along with temperature rise upon driving for discharge), as disclosed in Japanese Patent Laid-Open No. 56-89578 and U.S. Pat. No. 4,709,243.

In this case, if a current flowing through the heating element is so controlled as to make the voltage between both ends of the heating element constant, as disclosed in U.S. Pat. No. 6,523,922, the resistance of the heating element decreases at a high temperature, the current flowing through the heating element increases, and energy applied to the heating element further increases in the second half of driving.

It is known that the service life of the heating element becomes longer as the temperature of the heating element is lower after film boiling in bubble-jet printing utilizing the force of film boiling by heat of the heating element.

Among the printhead substrates, the resistance of the heating element (heating resistance element) which is the largest among resistance components varies by about 20% to 30% owing to manufacturing variations, as described above. Note that, in FIG. 16, the same reference numbers are added to the same constituent elements or matters as those described in FIGS. 14 and 15, and the description is omitted. Since the power supply voltage of the printing apparatus main body in a conventional mechanism is constant, energy applied to the heating element is made constant by adjusting a pulse width applied to the heating element upon variations in the resistance of the heating element, as also described above.

However, when a constant current is commonly supplied to the heating elements of a plurality of substrates in order to eliminate variations in energy caused by the difference in the number of simultaneously driven printing elements, like the prior art, the power loss on the inkjet printhead substrate by variations in the resistance of the heating element greatly changes.

FIG. 17 is a table showing variations in power loss when the heating element is driven at a constant current.

The example shown in FIG. 17 assumes variations in voltage generated at both ends of the heating element and manufacturing variations in heating element (in this case ±20%) when the resistance value of the heating element is about 100Ω and a 150-mA current is supplied as a constant current. FIG. 17 shows the ratio of energy consumed by constituent components other than the heating element when the heating element has a maximum resistance (120Ω), 1 V is necessary to control the driver voltage for a voltage (18 V) between both ends of the heating element, and a voltage (19 V) higher by 1 V is applied on the printing apparatus side in order to control a constant current. The power consumption of the heating element upon supply of a constant current changes (1.8 to 2.7 W) depending on variations (80 to 120Ω) in the resistance value of the heating element. Upon variations, application power is adjusted by changing the pulse width applied to the heating element in actual printing.

FIG. 17 also shows pulse widths necessary when energy is made constant.

In FIG. 17, as indicated in a dotted area 3001, when the resistance value of the heating element is 80Ω, about 58% of power applied to the heating element is mainly consumed (power loss) by a control part (driver part in the inkjet printhead substrate) for supplying a constant current. In order to make energy applied to the heating element constant even though the resistance value changes, the application pulse width is adjusted to 1.25 μs for a heating element resistance of 80Ω and 0.83 μs for a heating element resistance of 120Ω. As understood from a comparison between values in dotted areas 3002 and 3003, the ratio of these application pulse widths is about 1.5 times, and the difference in loss energy is different by about 10 times between the heating element resistances of 80Ω and 120Ω.

Particularly, when the resistance value of the heating element is 80Ω, about 58% of energy applied to the heating element is lost. On the other hand, when the resistance value of the heating element is 120Ω, the lost is about 6%. Thus, heat generated in the substrate also varies depending on the resistance value of the heating element.

If all the power is consumed within the inkjet printhead substrate, the substrate temperature goes up. This influences the ink discharge amount.

FIG. 18 is a graph showing the relationship between the printing time and the substrate temperature when a constant current is supplied to the inkjet printhead substrate.

As is apparent from FIG. 18, the degree of rise of the substrate temperature changes upon variations in the resistance of the heating element.

FIG. 19 is a graph showing the relationship between the ink temperature and the ink discharge amount.

As is apparent from FIG. 19, as the ink temperature changes, the ink discharge amount also changes. Since the ink temperature is influenced by the substrate temperature, the rise of the substrate temperature influences the ink discharge characteristic.

Hence, the fact that variations by about 20% to 30% in the resistance value of the heating element in manufacturing the printhead cannot be avoided means that it is very difficult to provide an inkjet printhead having uniform ink discharge performance.

As described above, when the method of driving the heating element at a constant current in order to eliminate the difference caused by a change in the number of simultaneously driven printing elements is introduced, energy is wastefully consumed owing to variations in the resistance value of the heating element in the printhead manufacturing process. Moreover, in actual printing, the temperature variation characteristic of the substrate changes, and the printing performance of the printhead greatly varies upon a change in ink viscosity or the like depending on the ink temperature.

SUMMARY OF THE INVENTION

Accordingly, the present invention is conceived as a response to the above-described disadvantages of the conventional art.

For example, a printhead substrate according to the present invention is capable of controlling a driver transistor for controlling a current flowing through a heating element, preventing variations in electric energy applied to the heating element even when the temperature of the heating element having a negative temperature coefficient changes and the resistance value of the heating element changes, prolonging the service life, and providing an excellent printing characteristic regardless of variations in the resistance value of the heating element.

According to one aspect of the present invention, preferably, there is provided a printhead substrate having a plurality of heating elements connected to a common power supply line, and a plurality of driver transistors respectively series-connected to the plurality of heating elements, comprising: a reference power supply which sets a reference voltage used to set a current value to be supplied to the plurality of heating elements on the basis of resistance values of the heating elements; a comparison circuit which compares the reference voltage with a potential difference of a wiring portion at which a change in resistance value is smaller than the heating element when driving the plurality of heating elements; and a control circuit which controls driving of each of the plurality of driver transistors on the basis of a comparison result of the comparison circuit.

Note that the wiring portion is a wiring resistance which is connected to the common power supply line and generated in a connection wiring line to series-connected to the heating element. Also, it is preferable that the control circuit controls to make the potential difference at the wiring resistance when driving the heating element and the reference voltage equal to each other.

It is further preferable that the control circuit includes: a dummy resistance which is parallel-connected to the heating element and has the same characteristic as a characteristic of the heating element; a dummy driver transistor which is series-connected to the dummy resistance and has the same characteristic as a characteristic of the driver transistor; a dummy wiring resistance which is series-connected to the dummy resistance and generated in a connection wiring line to the dummy resistance; and a detection element which feeds back a detection output to a gate terminal of the dummy driver transistor so as to make a potential difference of the dummy wiring resistance equal to the reference voltage.

Desirably, the detection output is connected to the gate terminal of the dummy driver transistor, and used as a power supply for a logic circuit which receives a selection signal representing whether or not to drive the heating element.

It is desirable that the reference power supply is a power source utilizing a band gap voltage, and the driver transistor is a MOS transistor.

It is further preferable in the printhead substrate that the reference power supply has a plurality of selectively settable reference voltages, and a reference voltage may be set from the plurality of reference voltages.

Furthermore, the driver transistor may be a MOSFET transistor, and the control circuit may adjust a gate voltage of the MOSFET transistor, or the control circuit controls to increase a gate voltage until a voltage drop amount by the wiring resistance and the reference voltage become equal to each other.

According to another aspect of the present invention, preferably, there is provided a printhead using the above described printhead substrate.

The printhead is preferably an inkjet printhead.

According to still another aspect of the present invention, preferably, there is provided a head cartridge using the above inkjet printhead and an ink tank containing ink to be supplied to the inkjet printhead.

According to still another aspect of the present invention, preferably, there is provided a printing apparatus which prints by the above printhead, comprising driving control means for controlling a driving signal to be supplied to each heating element so as to make a current amount flowing through each heating element constant regardless of a temperature of the heating element.

According to still another aspect of the present invention, preferably, there is provided a method of driving a printhead including a substrate having a plurality of heating elements connected to a common power supply line, and a plurality of driver transistors respectively series-connected to the plurality of heating elements, comprising: a measurement step of measuring resistance values of the plurality of heating elements of the substrate; a setting step of setting a reference voltage of a reference power supply used to set a current value to be supplied to the plurality of heating elements on the basis of the resistance values of the heating elements; a comparison step of comparing the reference voltage with a potential difference of a wiring portion at which a change in resistance value is smaller than the heating element when driving the plurality of heating elements; and a control step of controlling driving of each of the plurality of driver transistors on the basis of a comparison result at the comparison step.

The invention is particularly advantageous since a driver transistor for controlling a current flowing through a heating element is so controlled as to make energy as constant as possible, variations in energy applied to the heating element are prevented even when the temperature of the heating element having a negative temperature coefficient changes and the resistance of the heating element changes, and the service life is prolonged. Thus, high-quality printing can be realized with a long service life.

As disclosed in U.S. Pat. No. 6,523,922, variations in power supply voltage applied to the printhead and the influence of the wiring resistance and parasitic resistance can also be reduced by making a current flowing through the heating element constant. This can reduce the costs of the power supply device and wiring line. Also, the printing quality can be maintained because each printing element can be driven under constant conditions even upon variations in the characteristic of an internal element caused by a temperature change of the printhead.

Unlike the prior art, a voltage prepared by compensating possible voltage drops at the wiring line and connection portion as a margin need not be applied to the heating element to drive it. The printing element can be driven under optimal conditions, improving the durability of the printhead.

Even if the resistance value of the heating element varies in mass production of the printhead, an optimal current can be supplied to the heating element to print.

As a result, high-quality printing excellent in printing characteristic with a small power loss can be realized.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 9 is a table showing setting of a current value when the resistance value of heating element varies;

FIG. 17 is a table showing variations in power loss when driving the heating element at a constant current;

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The term "element substrate" used in the following description means not only a base of a silicon semiconductor but also a base having elements, wiring lines, and the like. "On an element substrate" means not only "on an element base", but also "on the surface of an element base" and "inside an element base near the surface".

The term "built-in" in the present invention means not "to arrange separate elements on a base", but "to integrally form or manufacture elements on an element base by a semiconductor circuit manufacturing process or the like".

A representative overall configuration and control configuration of a printing apparatus using a printhead according to the present invention will be described.

<Description of Inkjet Printing Apparatus (FIG. 1)>

Figure 1:
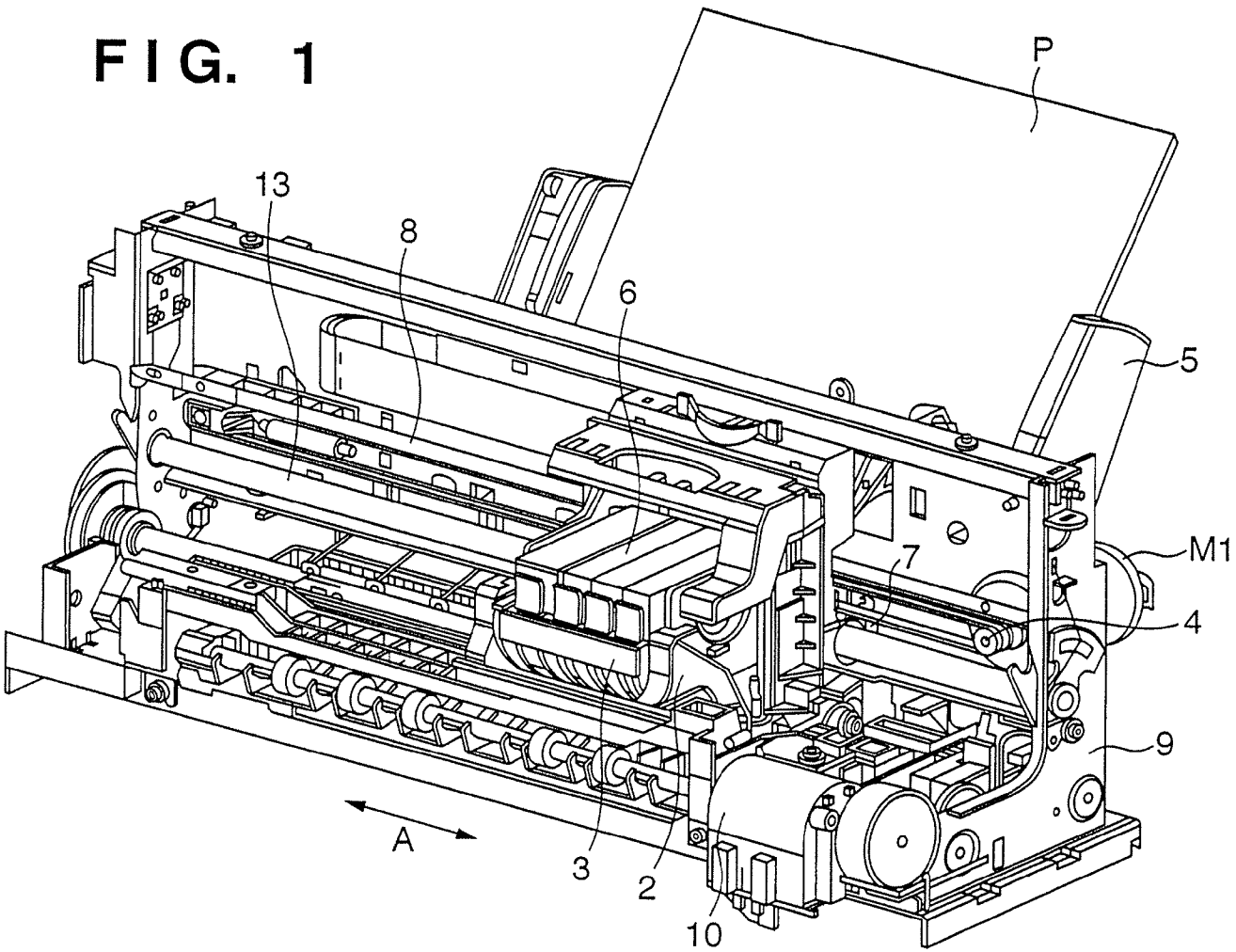
FIG. 1 is an outer perspective view showing the schematic arrangement of an inkjet printing apparatus 1 as a typical embodiment of the present invention.

FIG. 1 is an outer perspective view showing the schematic arrangement of an inkjet printing apparatus 1 as a typical embodiment of the present invention.

The inkjet printing apparatus 1 (hereinafter referred to as the printer) shown in FIG. 1 performs printing in the following manner. Driving force generated by a carriage motor M1 is transmitted from a transmission mechanism 4 to a carriage 2 incorporating a printhead 3, which performs printing by discharging ink in accordance with an inkjet method, and the carriage 2 is reciprocally moved in the direction of arrow A. A printing medium P, e.g., printing paper, is fed by a paper feeding mechanism 5 to be conveyed to a printing position, and ink is discharged by the printhead 3 at the printing position of the printing medium P, thereby realizing printing.

To maintain an excellent state of the printhead 3, the carriage 2 is moved to the position of a recovery device 10, and discharge recovery processing of the printhead 3 is intermittently performed.

In the carriage 2 of the printer 1, not only the printhead 3 is mounted, but also an ink cartridge 6 reserving ink to be supplied to the printhead 3 is mounted. The ink cartridge 6 is attachable/detachable to/from the carriage 2.

The printer 1 shown in FIG. 1 is capable of color printing. Therefore, the carriage 2 holds four ink cartridges respectively containing magenta (M), cyan (C), yellow (Y), and black (K) inks. These four cartridges are independently attachable/detachable.

Appropriate contact between the junction surfaces of the carriage 2 and the printhead 3 can achieve necessary electrical connection. By applying energy to the printhead 3 in accordance with a printing signal, the printhead 3 selectively discharges ink from plural discharge orifices, thereby performing printing. In particular, the printhead 3 according to this embodiment adopts an inkjet method which discharges ink by utilizing heat energy, and comprises electrothermal transducers for generating heat energy. Electric energy applied to the electrothermal transducers is converted to heat energy, which is then applied to ink, thereby creating film boiling. This film boiling causes growth and shrinkage of a bubble in the ink, and generates a pressure change. By utilizing the pressure change, ink is discharged from the discharge orifices. The electrothermal transducer is provided in correspondence with each discharge orifice. By applying a pulsed voltage to the corresponding electrothermal transducer in accordance with a printing signal, ink is discharged from the corresponding discharge orifice.

As shown in FIG. 1, the carriage 2 is connected to a part of a driving belt 7 of the transmission mechanism 4 which transmits driving force of the carriage motor M1, and is slidably supported along a guide shaft 13 in the direction of arrow A. Therefore, the carriage 2 reciprocally moves along the guide shaft 13 in accordance with normal rotation and reverse rotation of the carriage motor M1. In parallel with the moving direction of the carriage 2 (direction of arrow A), a scale 8 is provided to indicate an absolute position of the carriage 2. In this embodiment, the scale 8 is a transparent PET film on which black bars are printed in necessary pitches. One end of the scale 8 is fixed to a chassis 9, and the other end is supported by a leaf spring (not shown).

In the printer 1, a platen (not shown) is provided opposite to the discharge orifice surface where discharge orifices (not shown) of the printhead 3 are formed. As the carriage 2 incorporating the printhead 3 is reciprocally moved by the driving force of the carriage motor M1, a printing signal is supplied to the printhead 3 to discharge ink, and printing is performed on the entire width of the printing medium P conveyed on the platen.

Further, as shown in FIG. 1, the printer 1 includes the recovery device 10 for recovering discharge failure of the printhead 3, which is arranged at a desired position (e.g., a position corresponding to the home position) outside the reciprocal movement range for printing operation (outside the printing area) of the carriage 2 that incorporates the printhead 3.

<Control Configuration of Inkjet Printing Apparatus (FIG. 2)>

Figure 2:
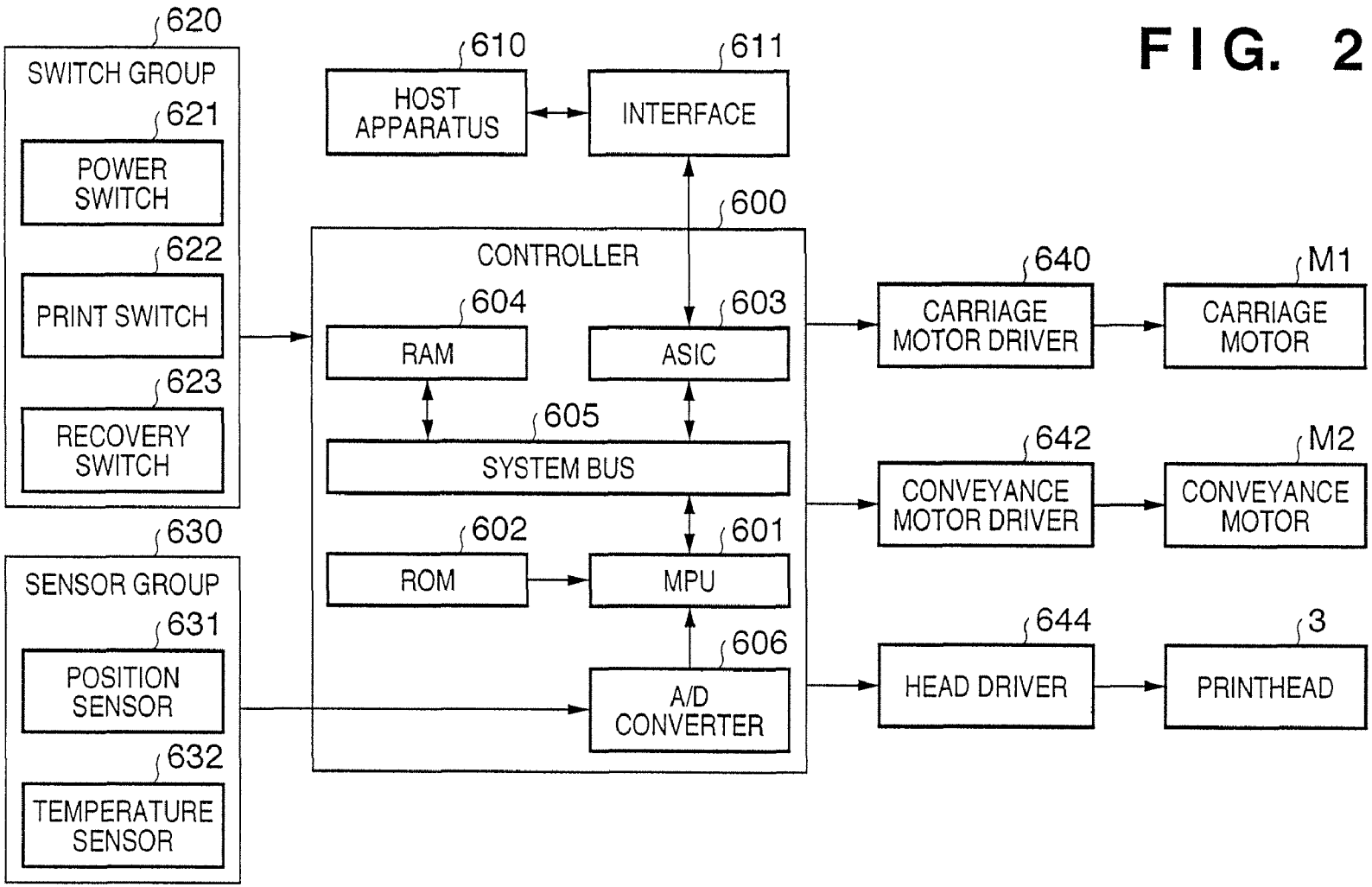
FIG. 2 is a block diagram showing the control configuration of the printing apparatus shown in FIG. 1.

FIG. 2 is a block diagram showing a control structure of the printer shown in FIG. 1.

Referring to FIG. 2, a controller 600 comprises: an MPU 601; ROM 602 storing a program corresponding to the control sequence which will be described later, predetermined tables, and other fixed data; an Application Specific Integrated Circuit (ASIC) 603 generating control signals for controlling the carriage motor M1, conveyance motor M2, and printhead 3; RAM 604 providing an image data developing area or a working area for executing a program; a system bus 605 for mutually connecting the MPU 601, ASIC 603, and RAM 604 for data transmission and reception; and an A/D converter 606 performing A/D conversion on an analog signal inputted by sensors which will be described later and supplying a digital signal to the MPU 601.

In FIG. 2, numeral 610 denotes a computer serving as an image data supplying source (or an image reader, digital camera or the like), which is generically referred to as a host unit. Between the host unit 610 and printer 1, image data, commands, status signals and so forth are transmitted or received via an interface (I/F) 611.

Numeral 620 denotes switches for receiving commands from an operator, which includes a power switch 621, a print switch 622 for designating a print start, and a recovery switch 623 for designating a start of the processing (recovery processing) aimed to maintain an excellent ink discharge state of the printhead 3. Numeral 630 denotes sensors for detecting an apparatus state, which includes a position sensor 631 such as a photo-coupler for detecting a home position h, and a temperature sensor 632 provided at an appropriate position of the printer for detecting an environmental temperature.

Numeral 640 denotes a carriage motor driver which drives the carriage motor M1 for reciprocally scanning the carriage 2 in the direction of arrow A. Numeral 642 denotes a conveyance motor driver which drives the conveyance motor M2 for conveying the printing medium P.

When the printhead 3 is scanned for printing, the ASIC 603 transfers driving data (DATA) of the heating element (discharge heater) to the printhead 3 while directly accessing the storage area of the RAM 602.

The ink cartridge 6 and printhead 3 may be separable, as described above, but may also be integrated to form an exchangeable head cartridge IJC.

Figure 3:
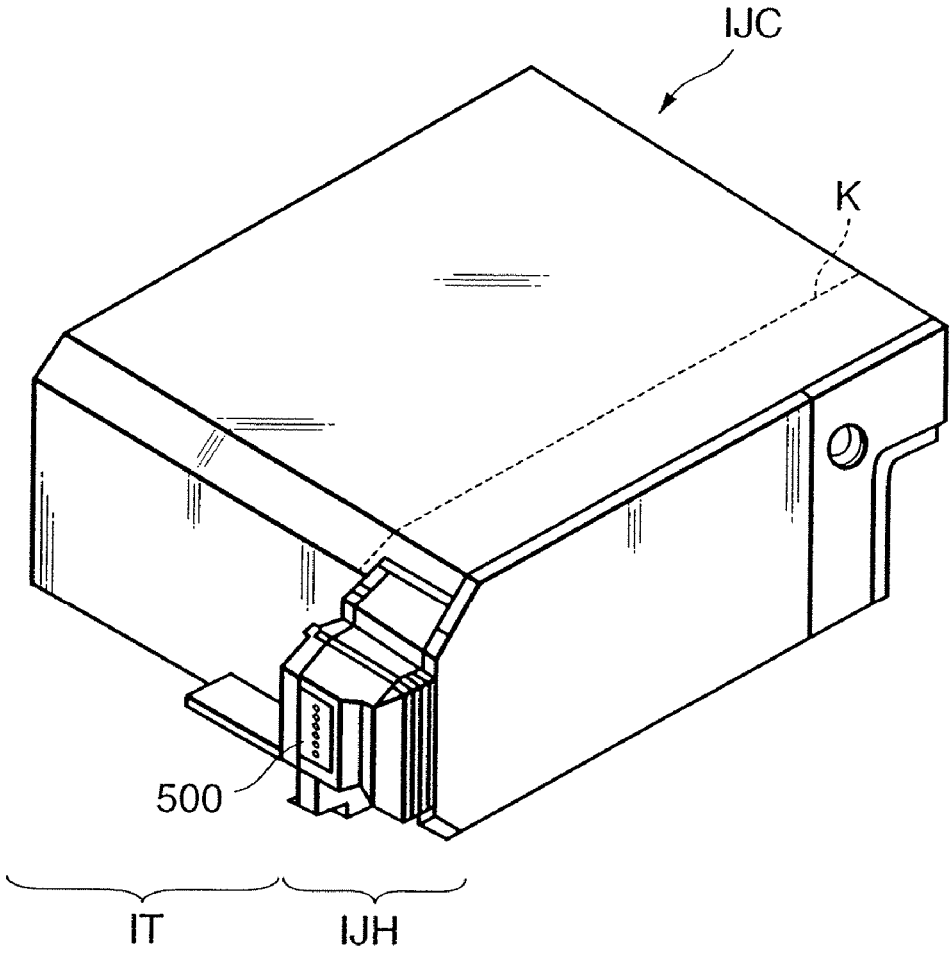
FIG. 3 is an outer perspective view showing the structure of a head cartridge obtained by integrating ink tanks and a printhead.

FIG. 3 is an outer perspective view showing the structure of the head cartridge IJC obtained by integrating the ink tanks and printhead. In FIG. 3, a dotted line K represents the boundary between an ink tank IT and a printhead IJH. The head cartridge IJC has an electrode (not shown) for receiving an electrical signal from the carriage 2 when the head cartridge IJC is mounted on the carriage 2. The electrical signal drives the printhead IJH to discharge ink, as described above.

In FIG. 3, reference numeral 500 denotes an ink orifice line. The ink tank IT incorporates a fibrous or porous ink absorber in order to hold ink.

Embodiments of the printhead according to the present invention that is mounted on the printing apparatus having the above configuration will be explained.

First Embodiment

Figure 4:
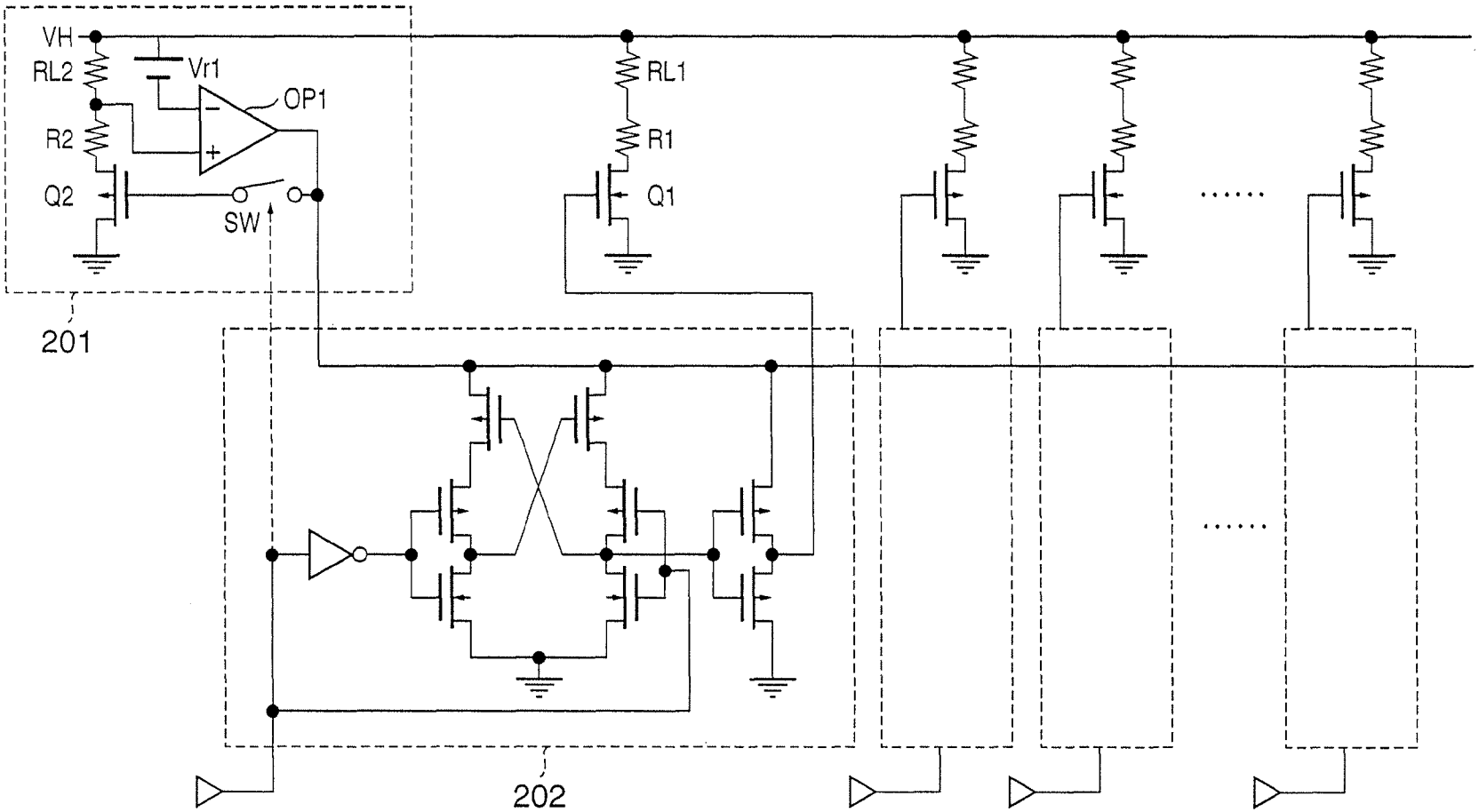
FIG. 4 is a circuit diagram showing the control circuit of each printing element of the printhead as a representative embodiment of the present invention.

FIG. 4 is a circuit diagram showing the configuration of a driving control circuit arranged for each printing element in a printhead according to the first embodiment of the present invention.

As shown in FIG. 4, each printing element is provided with a heater (heating element) R1 which generates thermal energy for discharging ink, a switching element Q1 such as a MOS transistor which supplies a current to the heater R1, a connection wiring resistance RL1 of the electrode wiring line of the heater R1, a bit selection logic circuit 202 which drives the switching (transistor) element Q1 in accordance with printing data by controlling a voltage applied to the gate of the transistor Q1, and a voltage control circuit 201 which supplies power to the bit selection logic circuit 202.

In the voltage control circuit 201, reference symbol R2 denotes a heater which is made of the same material as that of R1; Q2, a MOS transistor of the same type as Q1; and RL2, a connection wiring resistance of a wiring line connected to R2, similar to RL1. The heater R2, MOS transistor Q2, and connection wiring resistance RL2 are formed in the same manufacturing steps as those of the ink discharge heater R1, MOS transistor Q1, and resistance RL1 so as to have the same characteristics.

Reference symbol Vr1 denotes a constant voltage source using VH as a reference. An operational amplifier OP1 adjusts the gate of the transistor Q2 so as to make a voltage at the connection wiring resistance RL2 of the heater R2 equal to the voltage of the constant voltage source Vr1. As a result, the operational amplifier OP1 adjusts the potential difference at the connection wiring resistance RL1 of the heater R1 equal to the voltage of the constant voltage source Vr1. In this case, RL2, Q2, Vr1, and OP1 form a constant-voltage feedback circuit, and an output from this circuit is supplied as power to the bit control logic circuit 202.

The operation of the circuit shown in FIG. 4 will be explained.

A signal representing "0" or "1" based on printing data is input from the printing apparatus main body to an input IN of the bit control logic circuit 202 in accordance with information to be printed. In the circuit shown in FIG. 4, when "0" is input to the input, the MOS transistor Q1 is turned on, and a current flows through the heater R1 to discharge ink from a nozzle.

At this time, a voltage applied to the gate of the transistor Q1 is almost equal to the power supply voltage of the bit control logic circuit 202, and the power supply voltage is applied from the voltage control circuit 201. As described above, R2, Q2, and RL2 have the same characteristics as those of R1, Q1, and RL1, as described above. The ratio of the resistance value of R1, the ON resistance value of the transistor Q1, and the resistance value of RL1 is regarded as the same as the ratio of the resistance value of R2, the ON resistance value of the transistor Q2, and the resistance value of RL2. The non-inverting input of the operational amplifier OP1 is connected to one terminal of the connection wiring resistance RL2 and the source of the transistor Q2, whereas the inverting input of the operational amplifier OP1 is connected to the constant voltage source Vr1 using VH as a reference. The output of the operational amplifier OP1 is connected to the gate of the transistor Q2. Thus, the operational amplifier OP1 feeds back the gate voltage of the transistor Q2 so as to always maintain the potential difference between both ends of the connection wiring resistance RL2 at Vr1.

The output of the operational amplifier OP1 serves as a power supply to the bit control logic circuit 202. When driving the heater R1, the gate of the transistor Q1 receives the output voltage of the operational amplifier OP1, i.e., the same voltage as the gate voltage of the transistor Q2. Since the gate voltages of the transistors Q1 and Q2 are equal to each other, the ratio of the heater R1, the ON resistance values of transistor Q1 and the resistance value of RL1 becomes equal to the ratio of the heater R2, the ON resistance values of and transistor Q2 and the resistance value of RL2, and therefore the potential difference between the terminals of RL1 becomes equal to Vr1.

In this embodiment, the constant voltage source Vr1 does not have any dependency on variations in power supply voltage or any temperature characteristic, like a band gap voltage, and the potential difference between both ends of RL1 can always be kept constant.

Figure 5:
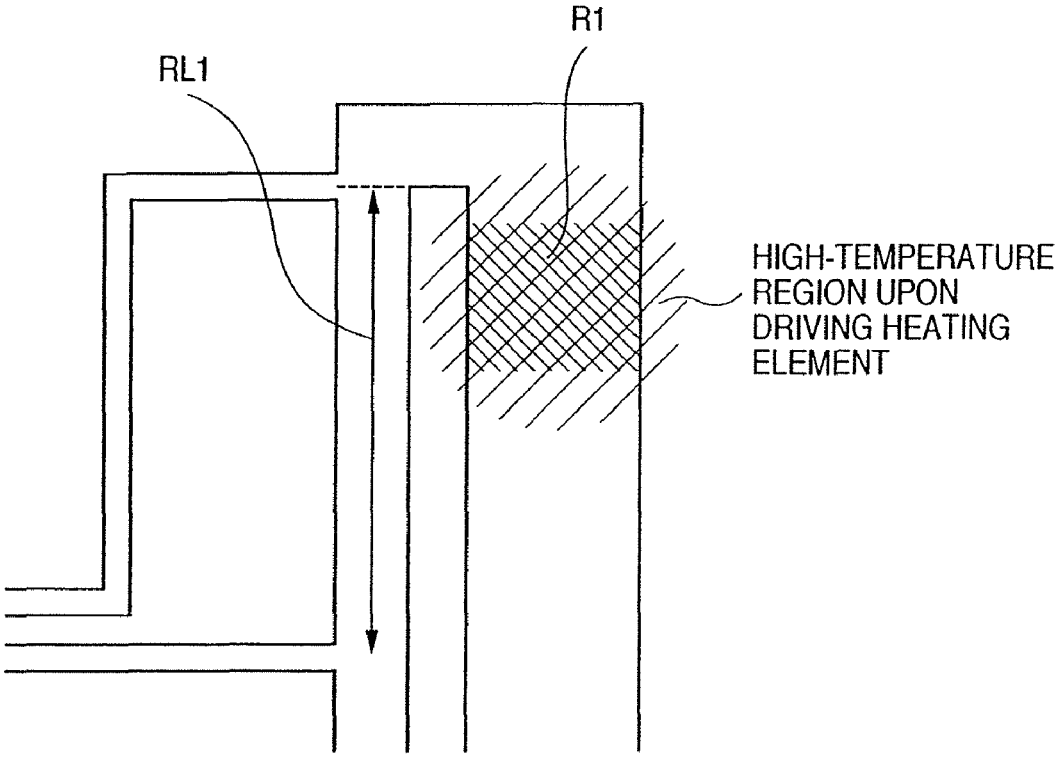
FIG. 5 is a view showing a heating element (heater) according to the present invention, a connection wiring resistance RL, and a region where the temperature abruptly rises upon driving.

FIG. 5 is a view showing a heating element peripheral region where the temperature abruptly rises when driving the heating element, and a wiring resistance series-connected to a heating element which is not comparatively influenced by the abrupt temperature rise.

Figure 6:
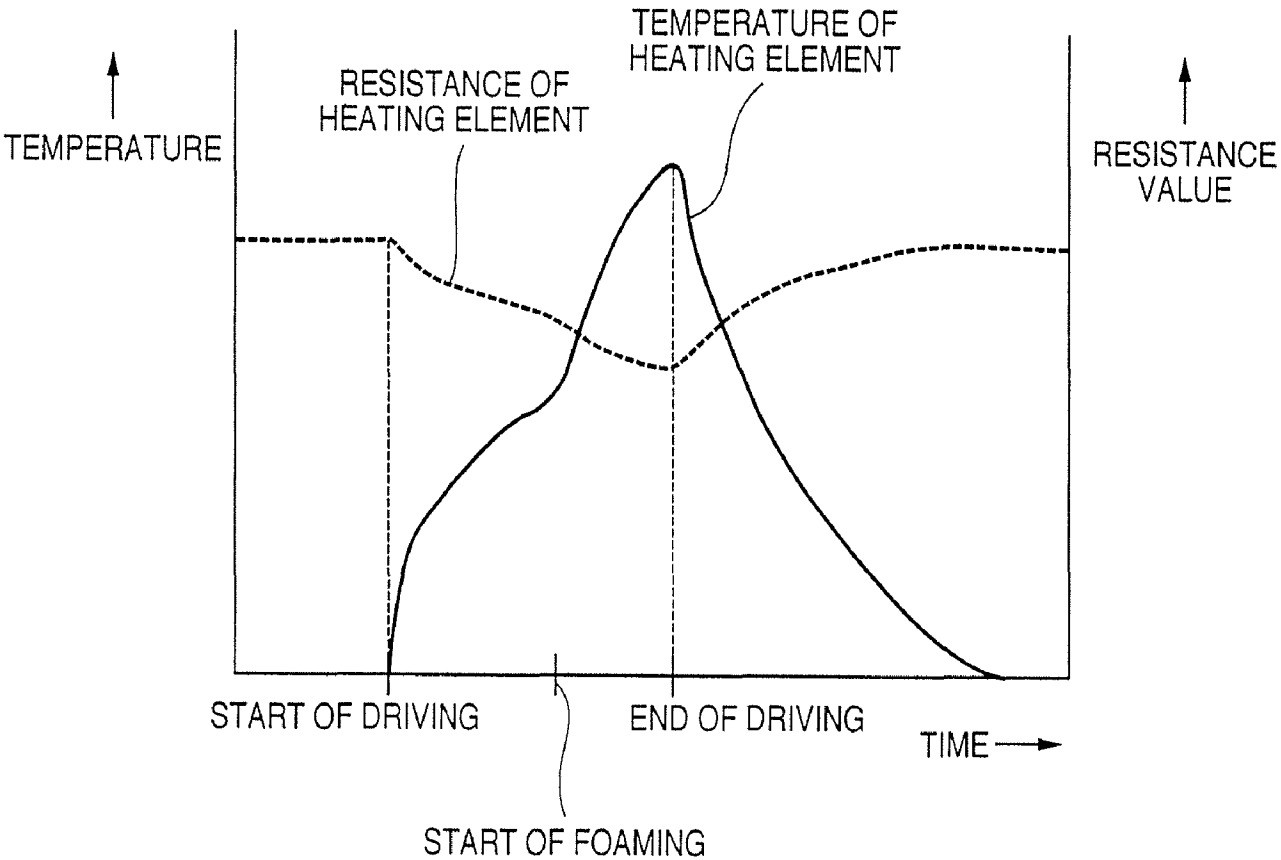
FIG. 6 is a graph showing the temperature of the heating element and a change in the resistance of the heating element when driving the heating element.

FIG. 6 is a graph showing an example of the temperature rise of the heating element when driving it and an example of a change in the resistance of the heating element upon temperature rise.

As is apparent from FIGS. 5 and 6, this embodiment adopts the connection wiring resistance RL in which the resistance rarely changes even when driving, compared to an energy increase (especially an abrupt temperature rise, i.e., an increase in energy applied to a heating element after the start of bubbling) caused by a decrease in the resistance value of the heating element upon temperature rise by driving when the voltage between both ends of the heating element is set constant, as disclosed in U.S. Pat. No. 6,523,922.

In other words, in this embodiment, a wiring resistance which is electrically connected to a heating element but not directly contacted to the heating element is utilized.

The potential difference of the connection wiring resistance RL1 generated in the electrode wiring line of the heater R1 is Vr1 and constant. If the resistance value of the heater R1 is measurable in advance using a dummy resistance or the like, a heat generation amount P of the heater R1 is given by $$P = I^2 \cdot R1 \cdot t$$

$$= (Vr1 / RL1)^2 \cdot R1 \cdot t$$

According to this embodiment, even though the resistance value of the heater R1 decreases due to temperature rise by driving energy, a current can be kept constant by the connection wiring resistance RL1 (=RL2) not influenced by the temperature. As a result, energy applied to the heater R1 in the second half of the driving period decreases. Therefore, this can suppress the temperature rise of the heater R1, and achieve a long service life.

Note that the constituent components of the circuit shown in FIG. 4 can be integrally formed as an element substrate on a printhead substrate manufactured by a semiconductor process.

Second Embodiment

Figure 7:
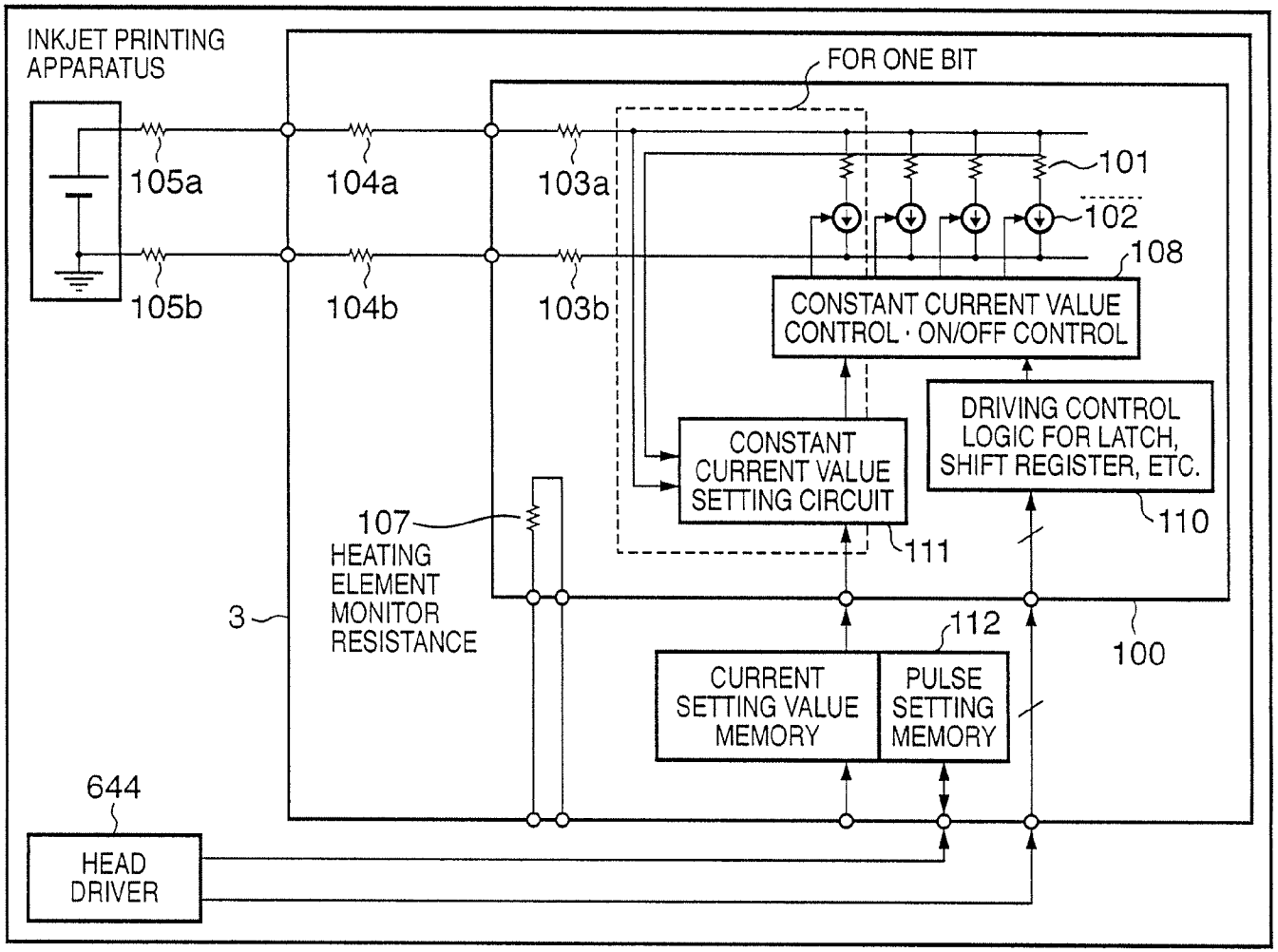
FIG. 7 is a block diagram showing the configurations of an inkjet printhead substrate, a printhead integrating the substrate, and a part which influences energy applied to a heating element in a printing apparatus using the printhead.

FIG. 7 is a block diagram showing the configurations of an inkjet printhead substrate (to be referred to as a substrate hereinafter) 100 according to the second embodiment of the present invention, a printhead 3 integrating the substrate, and a part, of a printing apparatus using the printhead, which influences energy applied to a heating element.

The apparatus main body comprises a power supply which supplies power to the printhead and heating element substrate, and the power supply supplies a predetermined voltage and current to the element substrate.

A description of a part which is identical to that of a conventional substrate described with reference to FIGS. 14 to 19 will be omitted, and only a characteristic part of the second embodiment to which the present invention is applied will be described.

In FIG. 7, reference numeral 101 denotes each heating element (heating resistance element); and 102, each heating element switching element (driver) for supplying a constant current to the heating element, including voltage control. Reference numerals 103*a* and 103*b* denote parasitic resistances which are generated in common wiring lines within the substrate 100; 104*a* and 104*b*, parasitic resistances which are generated in common wiring lines within the printhead 3; 105*a* and 105*b*, parasitic resistances which are generated in common wiring lines in the printing apparatus; and 107, a monitor resistance which is formed in the same step as formation of the heating element in order to reflect the representative resistance value of the heating element 101 of the substrate 100.

Reference numeral 108 denotes a controller which ON/OFF-controls the driver 102 on the basis of image data for printing that is sent from a head driver 644 of the printing apparatus via a shift register, latch, and the like and a driving pulse signal for supplying ink discharge energy to the heating element, and performs a process such as total gate width selection in order to perform control of supplying a constant current to the heating element regardless of the voltage drop generated in the parasitic resistance upon a change in the number of simultaneously driven heating elements on the basis of the resistance value of the monitor resistance 107. Reference numeral 110 denotes a driving control logic unit which controls the pulse width of a driving pulse for driving the heating element.

Reference numeral 112 denotes a head memory serving as a nonvolatile memory (e.g., EEPROM, FeRAM, or MRAM) which stores, for each heating element, setting information on a constant current value determined by reflecting the resistance value of the monitor resistance 107. In the second embodiment, a voltage generated at both ends of the heating element 101 is optimized on the basis of information stored in the head memory 112, and the energy loss of the driver 102 can be minimized regardless of variations between heating elements in the manufacture or the like.

Reference numeral 111 denotes a setting circuit which sets a constant current on the basis of information read out from the head memory 112.

Figure 8:
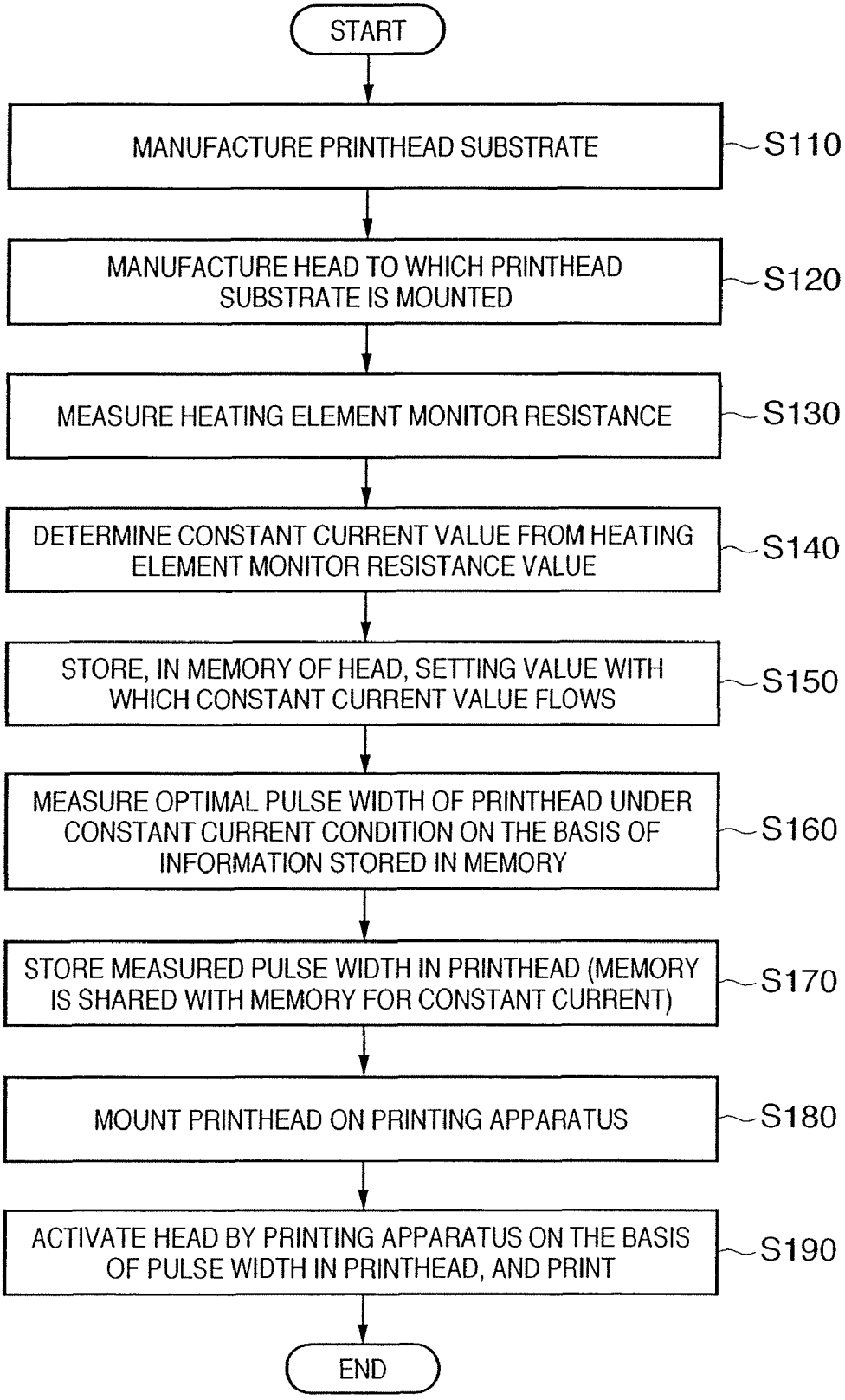
FIG. 8 is a flowchart showing a process of manufacturing a substrate, manufacturing a head, mounting the printhead on a printing apparatus, and printing.

FIG. 8 is a flowchart showing a process of manufacturing a substrate, manufacturing a head, mounting the printhead on a printing apparatus, and printing according to the second embodiment.

In step S110, a substrate 100 is manufactured by a semiconductor manufacturing process. The manufacturing process is basically the same as a conventional one. In the second embodiment, heating elements 101, a monitor resistance 107, a controller 108, and a setting circuit 111 which sets for each heating element a constant current value determined in accordance with the resistance value are built in the manufactured substrate 100.

In step S120 after manufacturing the substrate, the substrate, other components, and the like are assembled into a printhead 3. The printhead 3 comprises a head memory 112 which stores information for setting a constant current value for each heating element and determining the driving time of the heating element. In order to determine a constant current value, the resistance value of the monitor resistance 107 is read in step S130 after assembling the printhead 3. In step S140, an optimal current value to be supplied to heating elements with manufacturing variations is determined on the basis of the resistance value.

Setting of a current value when the resistance value of the heating element varies will be explained.

FIG. 9 is a table showing setting of a current value when the resistance value of the heating element varies according to the second embodiment.

The second embodiment assumes the same conditions as those described in the prior art, that is, a case in which the resistance value of the heating element is about 100Ω and varies by ±20% owing to manufacturing variations. The constant current value is so set as to generate at both ends of the heating element a voltage (in this case 15 V) obtained by subtracting the maximum variation value (in this case 1 V) of a driver voltage for controlling a constant current from the power supply voltage.

For example, when the resistance value of the heating element is 80Ω, a current which provides a voltage of 15 V at both ends of the heating element is 188 mA. In order to provide the information to the substrate 100 so as to set the current value to 188 mA, the information is written in the head memory 112. For a substrate having another resistance value, information may be written in the head memory 112 so as to set a proper current in accordance with the table shown in FIG. 9.

In this manner, step S150 is performed.

Step S160 of supplying a constant current on the basis of the information set in the head memory 112 will be explained with reference to FIG. 10.

Figure 10:
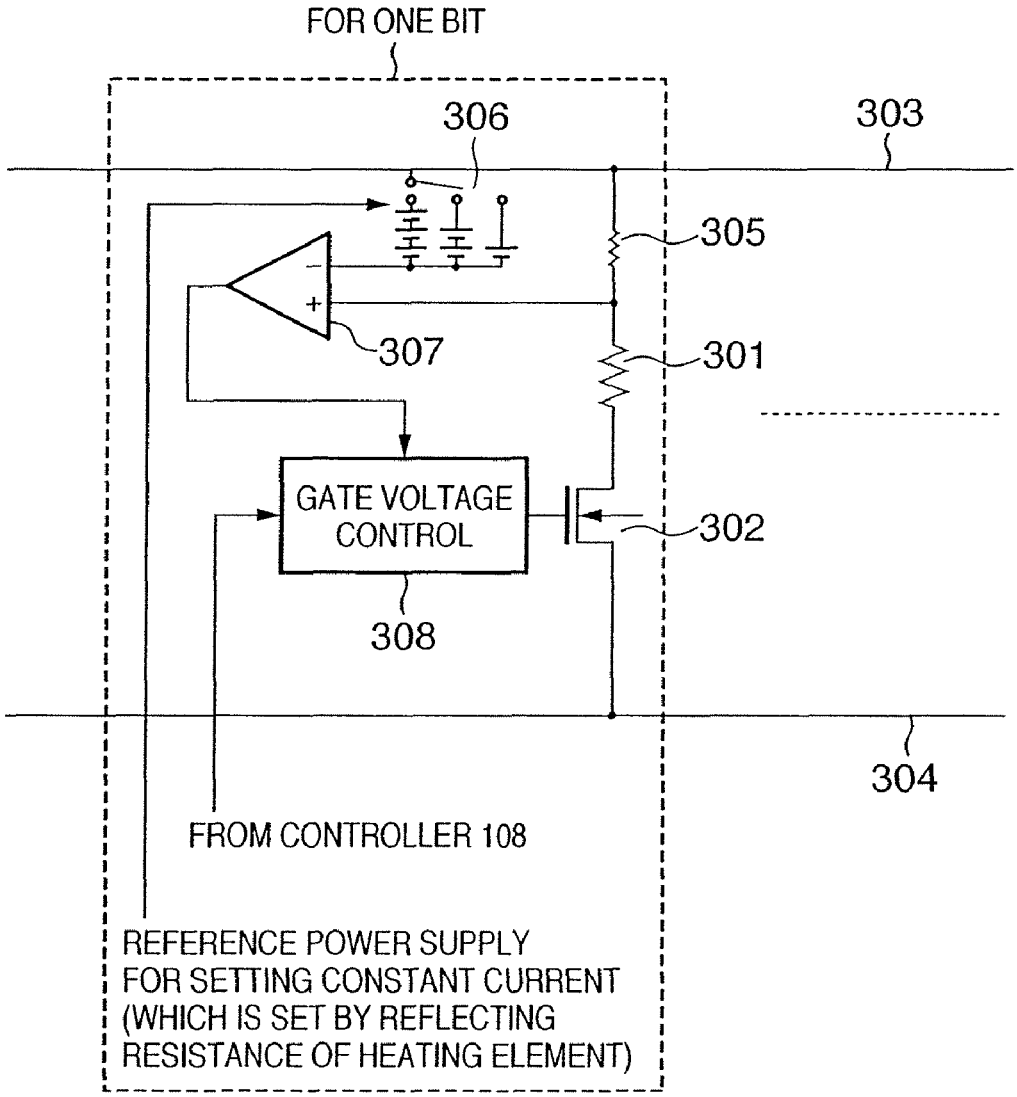
FIG. 10 is a view showing a configuration in which a heating element 301 and a block for driving the heating element are extracted for one bit.

FIG. 10 is a view showing a configuration in which the heating element 301 and a block for driving the heating element are extracted for one bit.

In FIG. 10, reference numeral 301 denotes a heating element; 302, a MOS transistor driver which changes its ON resistance in accordance with a flowing current and converges the current to a desired current in order to supply a constant current to the heating element (heater) 301; 303, a heating element driving power supply line within the substrate 100; 304, a GND line; 305, a small parasitic resistance generated in a wiring line for energizing the heating element 301; and 306, a reference power supply capable of changing the voltage by reflecting current information set in the head memory 112, i.e., reflecting the resistance value of the heating element. In this case, the reference power supply is, e.g., a voltage source for a band gap voltage free from any variations in power supply voltage and any temperature dependency. Reference numeral 307 denotes an OP amplifier; and 308, a gate voltage controller which applies a driver driving power supply voltage from the OP amplifier 307 to the driver 302 in accordance with a logic signal from the controller 108.

In the circuit having this configuration, the OP amplifier 307 controls to increase the gate voltage of the driver until a voltage drop generated in the parasitic wiring resistance 305 in accordance with a current individually flowing through each heating element becomes equal to the reference voltage. The resistance value of the parasitic wiring resistance 305 is almost constant because energy is not consumed, unlike the heating element (heater), and the temperature does not abruptly change. Hence, the voltage of the reference power supply 306 can be changed on the basis of current information set in the head memory 112 in order to set a current value calculated from the resistance value of the monitor resistance 107. As a result, a constant current can be supplied to the heating element.

In this manner, this circuit maintains a constant current for each heating element by feeding back a current flowing through the heating element and controlling the gate voltage of the driver 302. Since the current value can be so set as to minimize the voltage controlled by the driver 302, the energy loss by supply of a constant current can be suppressed constant and small regardless of the resistance value of the heating element.

Needless to say, even if voltage drops generated commonly to heating elements owing to the parasitic resistances 103*a*, 103*b*, 104*a*, 104*b*, 105*a*, 105*b*, and the like shown in FIG. 7 become different upon a change in the number of simultaneously driven heating elements, energy applied to the heating element does not vary because the configuration according to this embodiment makes a current flowing through each heating element constant. The voltage control range by the driver 302 suffices to be set in advance consideration of the difference between possible voltage drops in common wiring lines.

With the above-described configuration, even when the resistance value of the heating element varies within a range of 80 to 120Ω, a constant current is determined and set in accordance with the resistance value of the heating element, as shown in FIG. 9. This can eliminate a large power loss (58%) on the low-resistance value, which was a problem in the prior art, and the power loss can be made constant in the entire range where the resistance varies.

The width of a signal pulse for energizing each heating element in order to supply an almost constant energy to ink is so determined as to stably discharge ink with a printhead having a current value set as described above. In practice, the gate width is gradually increased from a given value to set a pulse width at which ink discharge stabilizes.

Step S160 is performed in the above fashion.

Note that FIG. 9 shows an example of pulse widths which supply almost the same energy.

In FIG. 9, when energy applied to one heating element is 2.25 μJ, a pulse width of 0.8 μS to 1.2 μS is preferable in accordance with the resistance of the heating element. As is apparent from the energy loss value shown in FIG. 9, the energy loss exhibits a difference of 10 times due to variations in the resistance value of the heating element in the prior art, whereas the energy loss is kept constant even upon variations in the resistance value of the heating element and the loss value is kept minimum (about 6.7% in an example of FIG. 9) in the second embodiment.

In step S170, the determined pulse width is stored as pulse width information in the head memory 112 of the printhead 3.

In step S180, the manufactured/set printhead 3 is mounted on a printing apparatus. In step S190, the printing apparatus prints by supplying a printing signal from the head driver 644 to the printhead 3 and substrate 100 on the basis of the pulse width information stored in the head memory 112 and image information to be printed.

According to the above-described embodiment, the reference voltage of a reference power supply used for driving control of driving the heating element is set for each printhead on the basis of the value of the monitor resistance provided in the printhead. The reference voltage and a voltage drop amount caused by the parasitic resistance of each heating element are compared, and the gate voltage of the MOS transistor which drives the heating element is controlled on the basis of the comparison result. A current supplied to each heating element can, therefore, be kept constant.

The configuration in which the current becomes constant for one heating element has been described.

Figure 11:
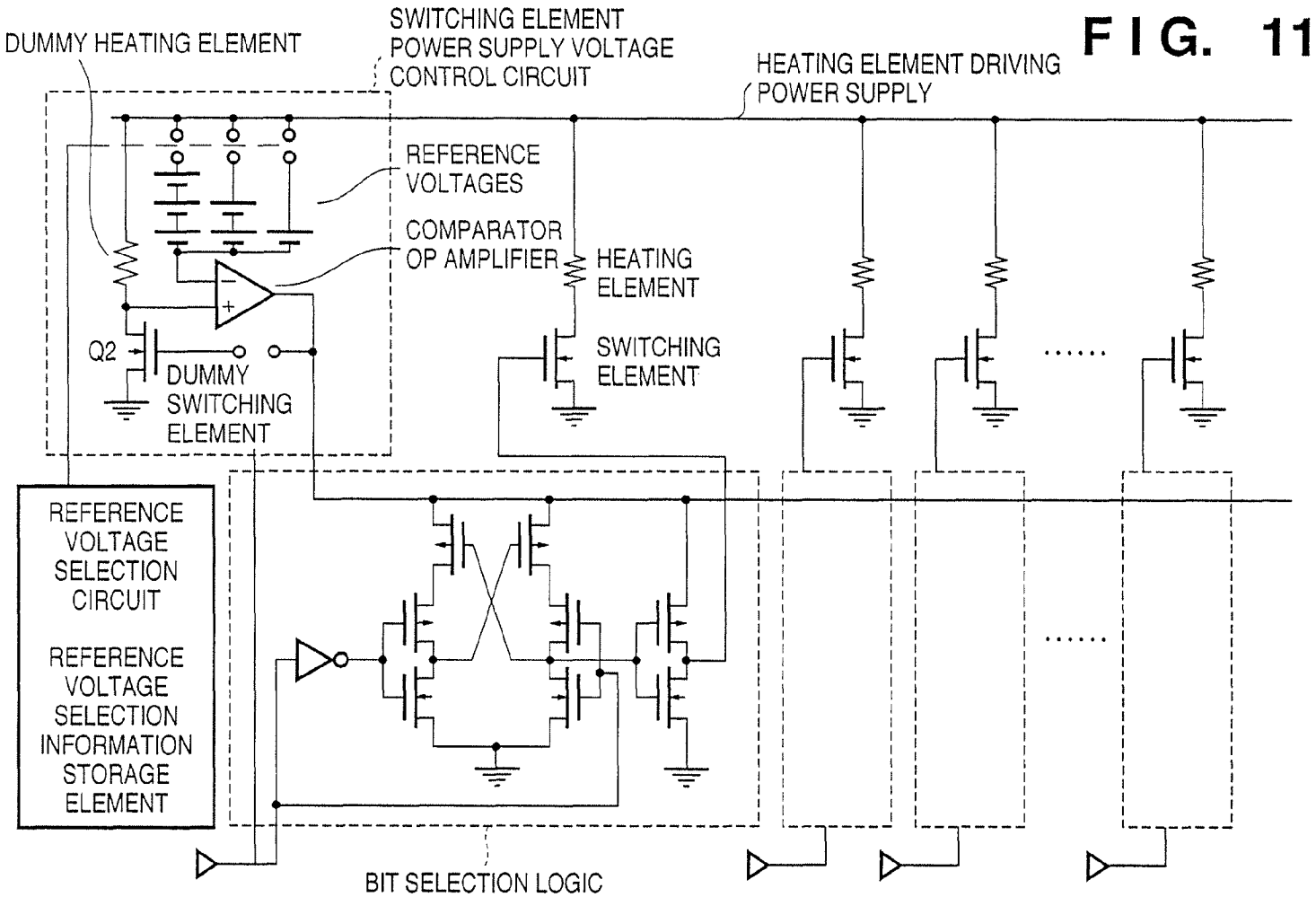
FIG. 11 is a diagram showing a circuit configuration within a printhead substrate according to another embodiment.
Figure 12:
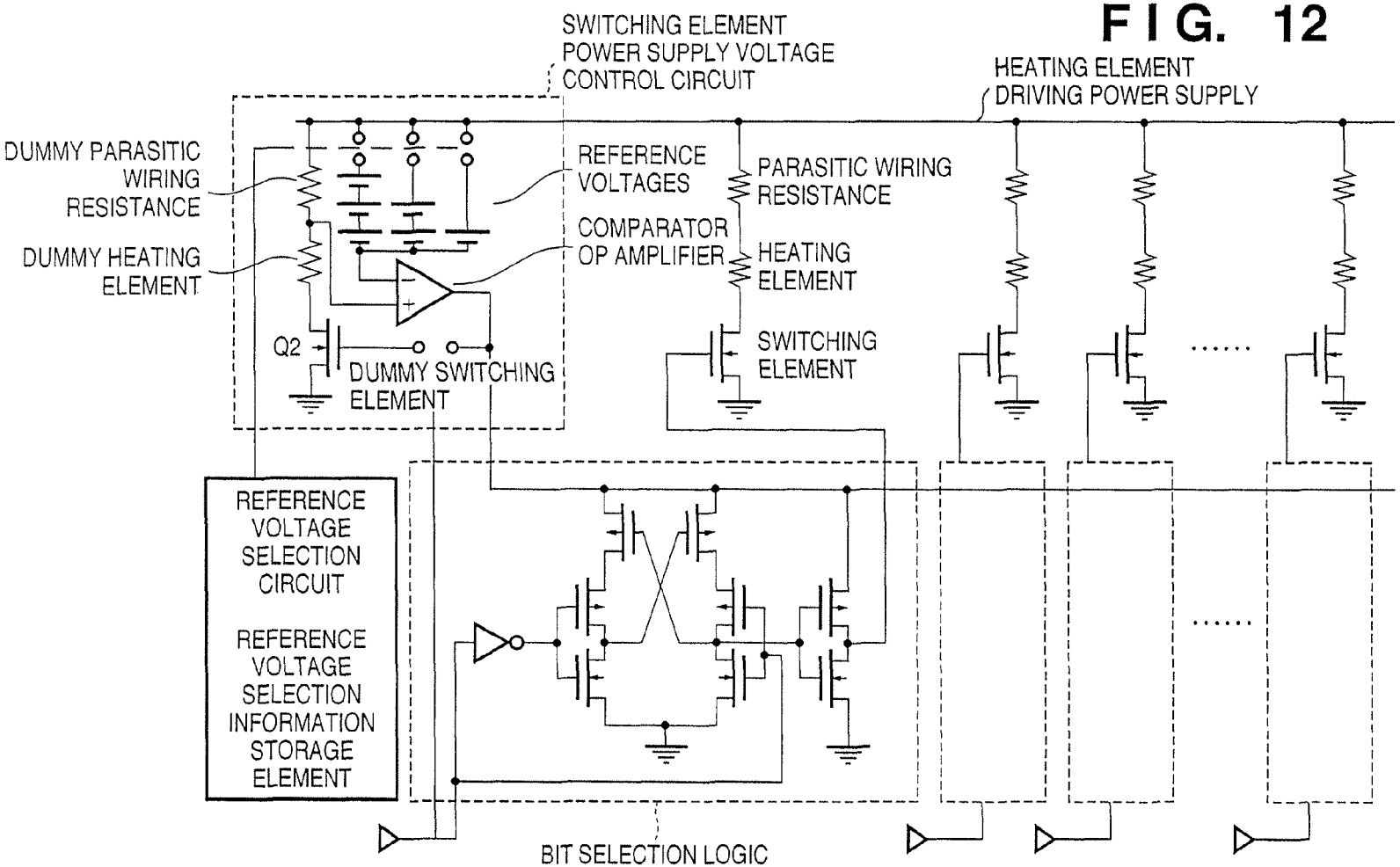
FIG. 12 is a diagram showing a circuit configuration within a printhead substrate according to still another embodiment.
Figure 13:
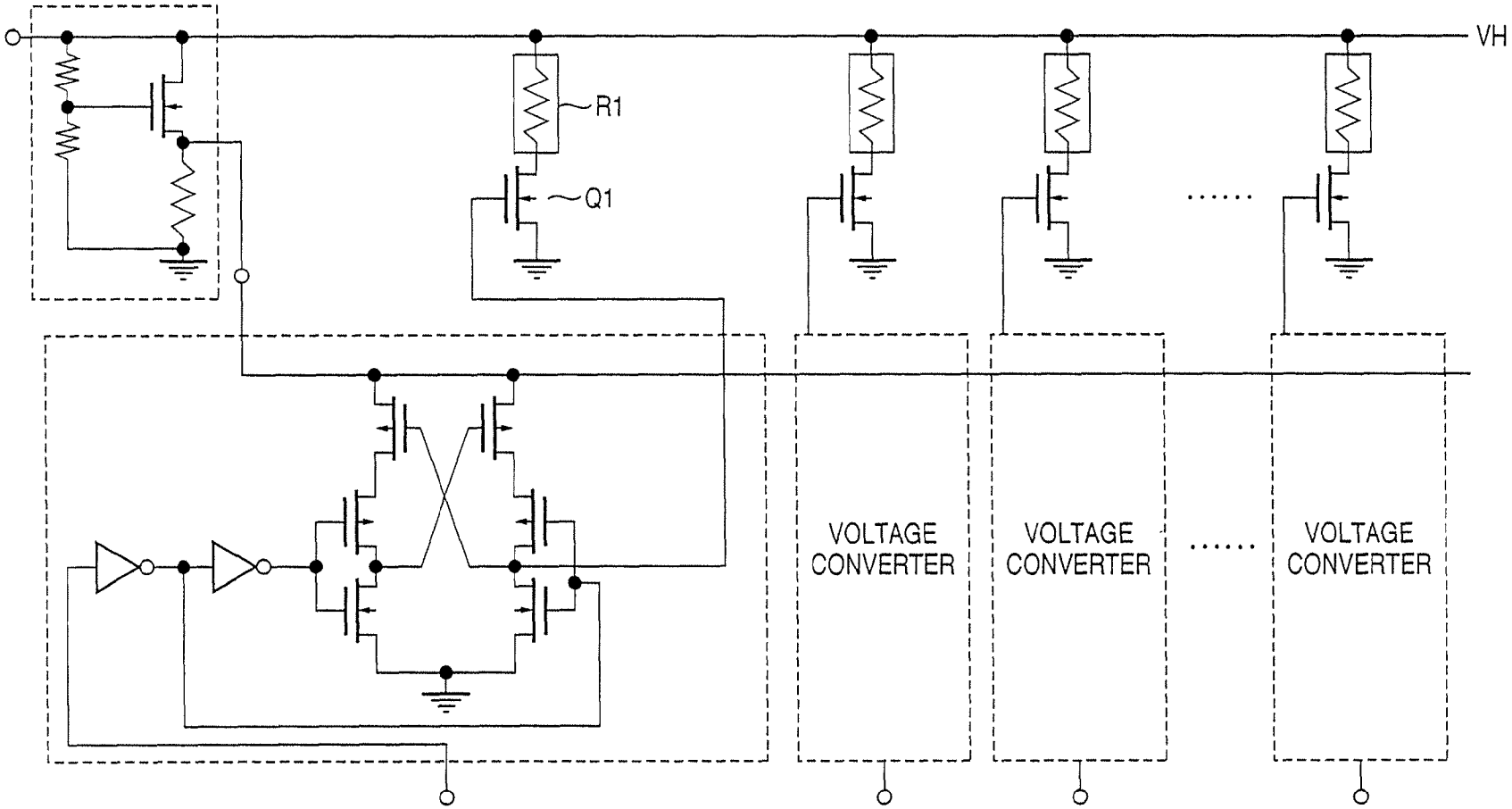
FIG. 13 is a circuit diagram showing a conventional printhead driving circuit.
Figure 14:
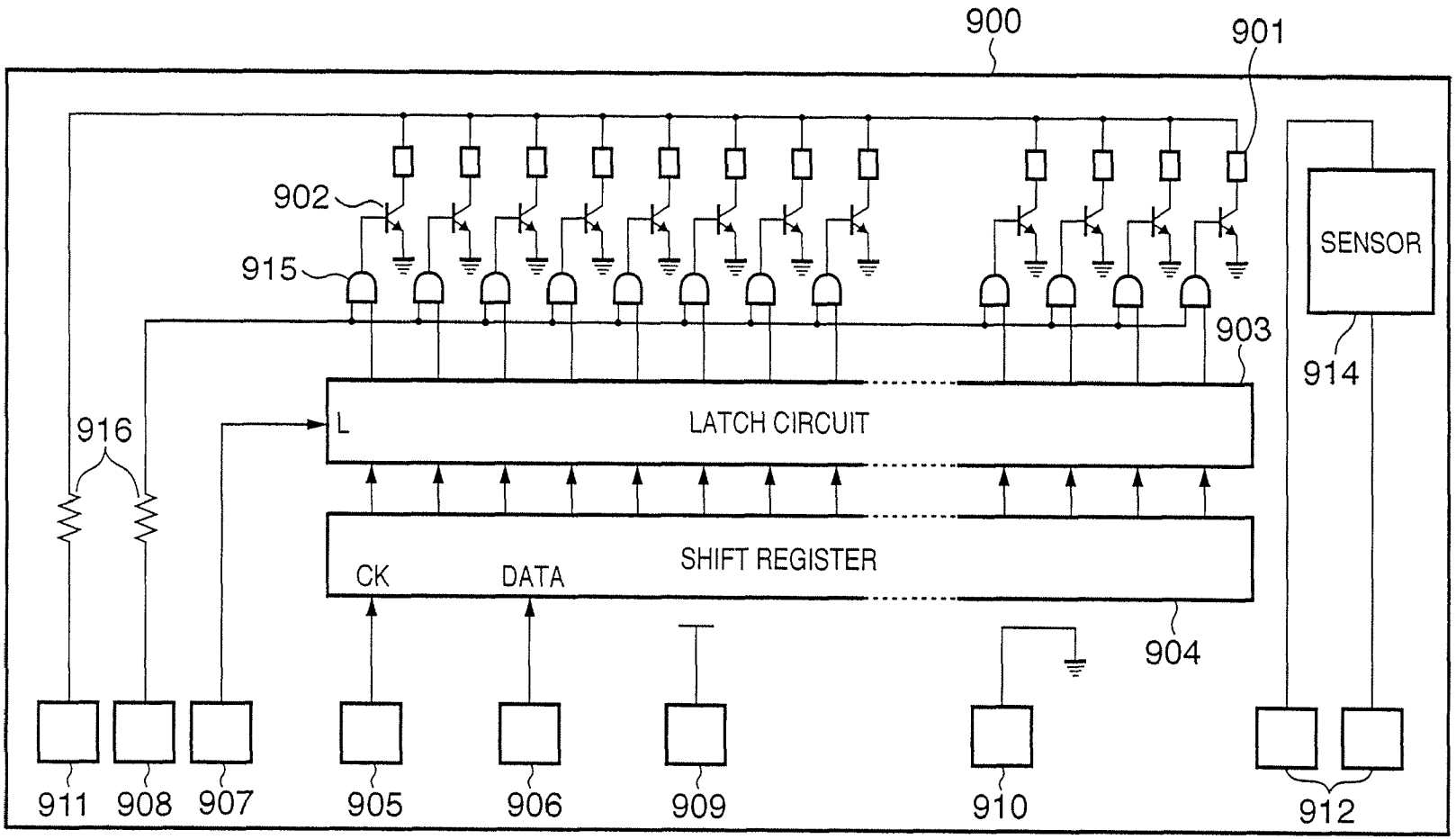
FIG. 14 is a block diagram showing a representative example of the configuration of a conventional inkjet printhead substrate.
Figure 15:
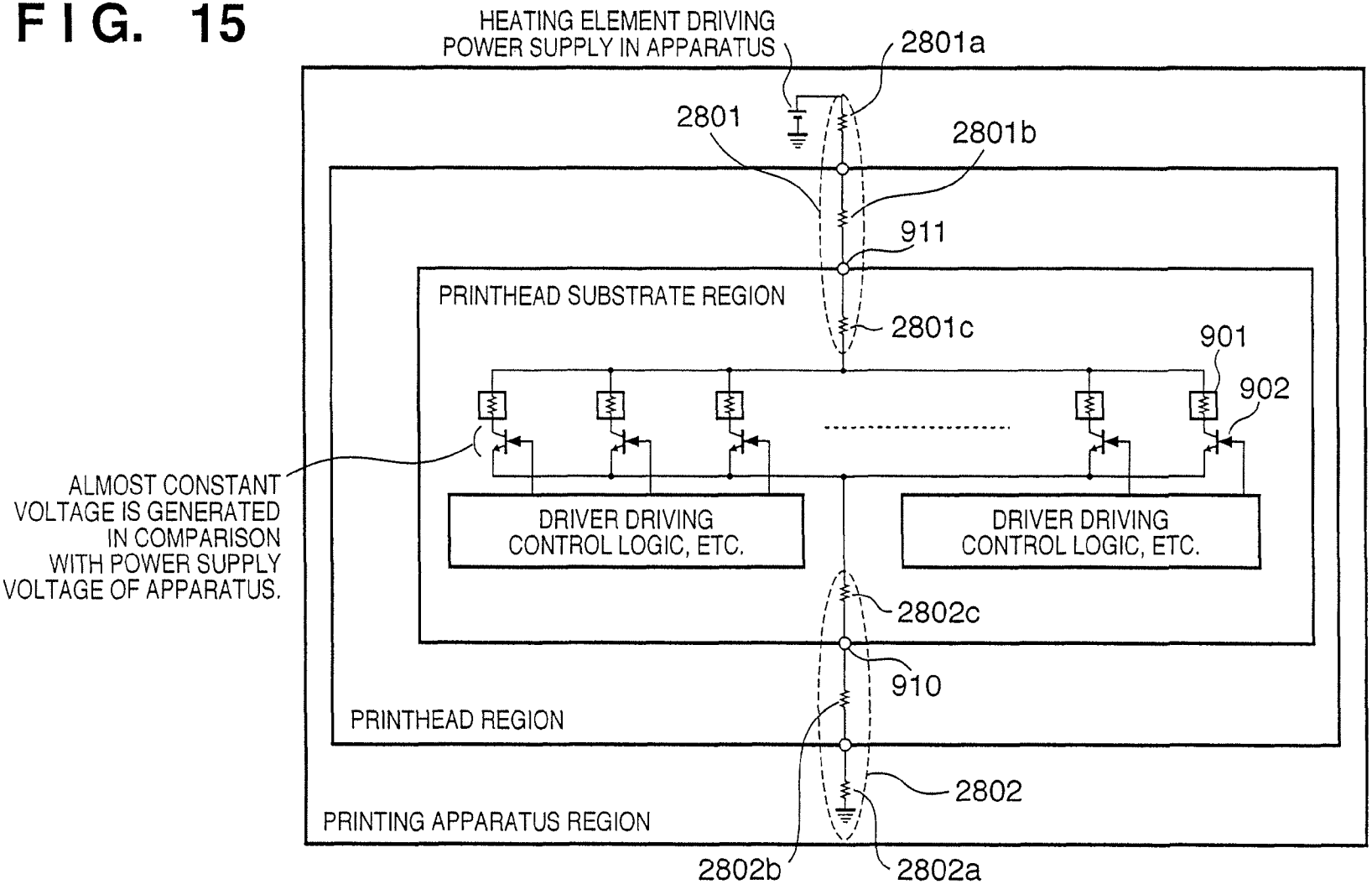
FIG. 15 is a view showing in detail a part associated with variations in parasitic resistance on the inkjet printhead substrate shown in FIG. 14.
Figure 16:
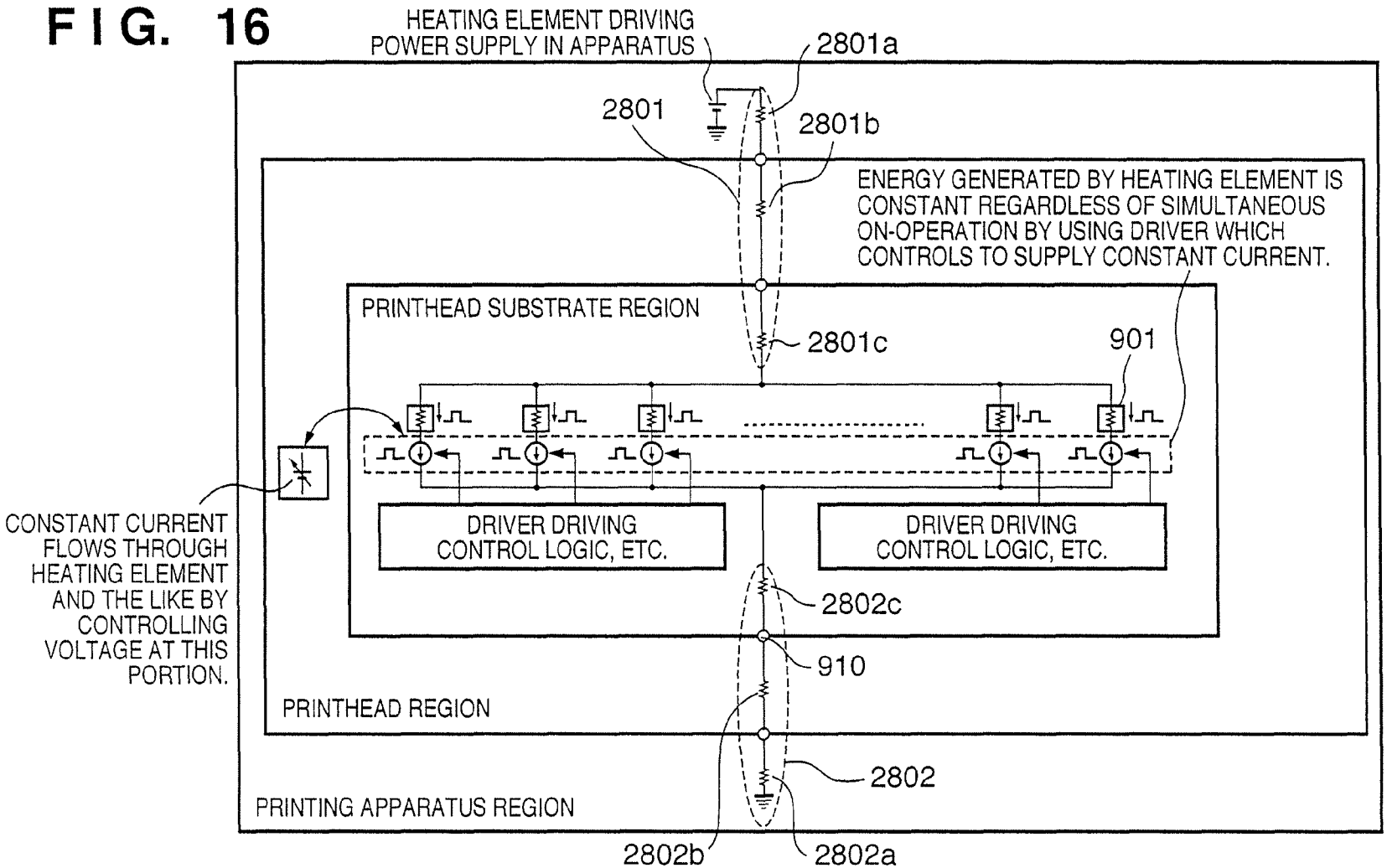
FIG. 16 is a view showing a configuration which controls a driver part so as to supply a constant current to each heating element.
Figure 18:
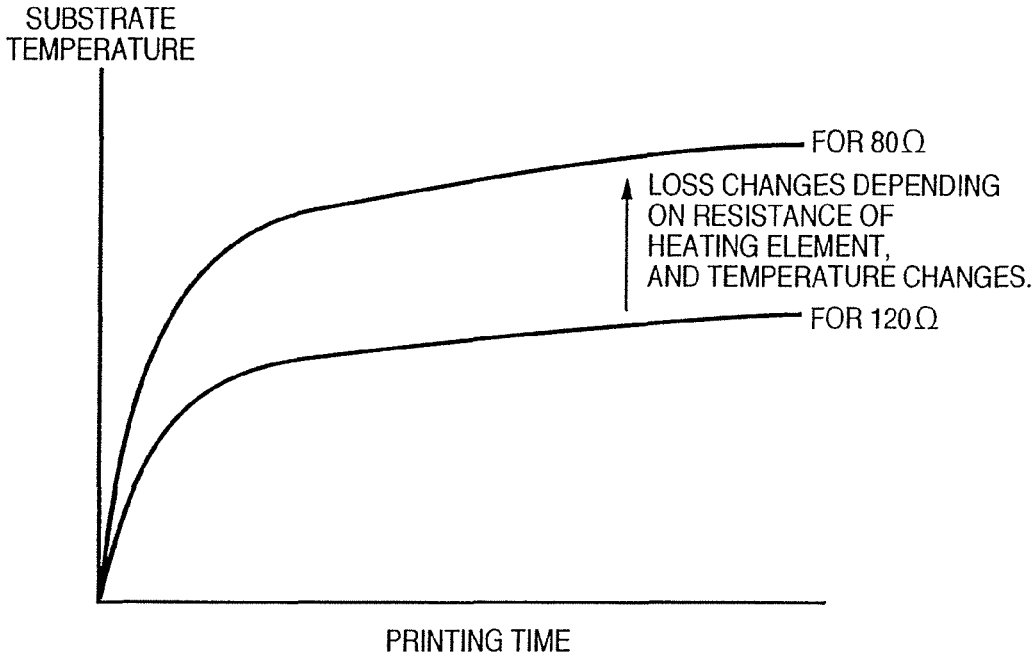
FIG. 18 is a graph showing the relationship between the printing time and the substrate temperature when a constant current is supplied to the inkjet printhead substrate.
Figure 19:
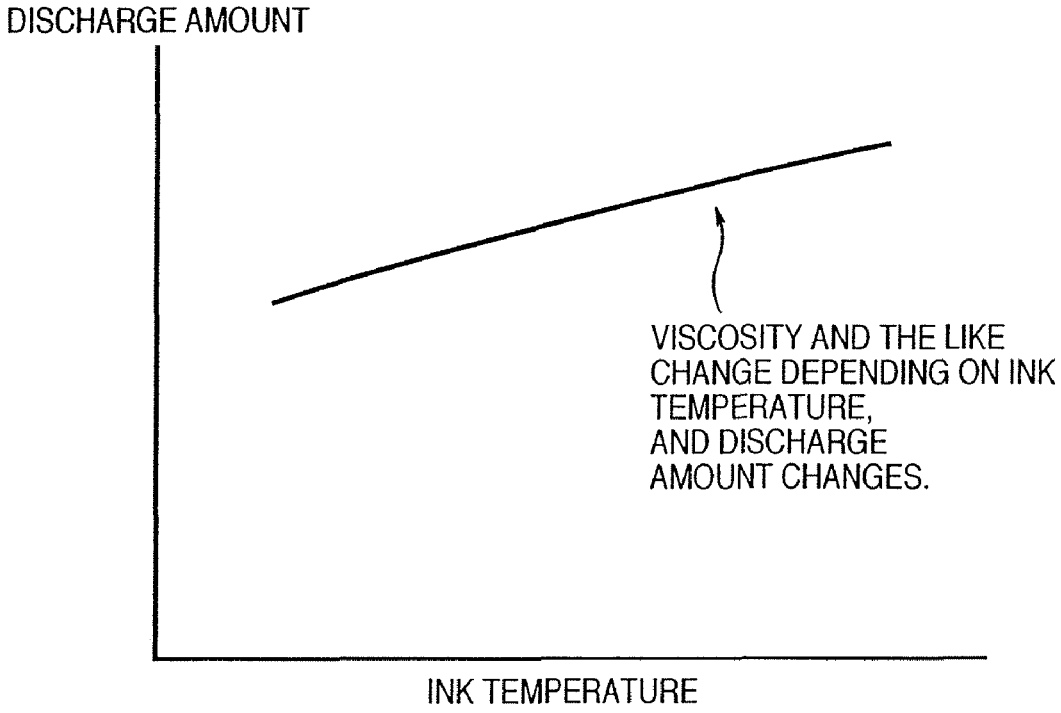
FIG. 19 is a graph showing the relationship between the ink temperature and the ink discharge amount.

The printhead has a plurality of printing elements, and each printing element is equipped with the above-described configuration to keep a current, i.e., energy supplied to the heating element constant. Alternatively, this configuration can be adopted in unit of simultaneously driven printing elements and shared among the units. The same effects can also be obtained by setting a dummy heating element, as disclosed in U.S. Pat. No. 6,523,922, and selecting a plurality of reference voltages (see FIG. 11). In addition to the configuration shown in FIG. 11, FIG. 12 shows an example of a configuration in which voltages at parasitic resistances are so compared as to make a current flowing through the heating element constant.

As a result, stable, high-quality printing and a long-service-life printhead can be achieved.

Note that in the foregoing embodiments, although the description has been provided based on an assumption that a droplet discharged by the printhead is ink and that the liquid contained in the ink tank is ink, the contents are not limited to ink. For instance, the ink tank may contain processed liquid or the like, which is discharged to a printing medium in order to improve the fixability or water repellency of the printed image or to improve the image quality.

The above-described embodiments have exemplified a so-called bubble-jet type inkjet printhead which abruptly heats and gasifies ink by a heater (heating element) and discharges ink droplets from an orifice by the pressure of generated bubbles. Considering the operations and effects of the present invention which suppresses variations in power supply voltage and the influence of a parasitic resistance in the connection, the present invention can be evidently applied to a printhead which prints by a method other than bubble-jet printing method.

In this case, the heater (heating element) in the embodiments is replaced with an element used in each method.

However, we note that each of the above-described embodiments comprises means (e.g., an electrothermal transducer or the like) for generating heat energy as energy utilized upon execution of ink discharge, and adopts the method which causes a change in state of ink by the heat energy, among the ink-jet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

Furthermore, although each of the above-described embodiments adopts a serial-type printer which performs printing by scanning a printhead, a full-line type printer employing a printhead having a length corresponding to the width of a maximum printing medium may be adopted. For a full-line type printhead, either the arrangement which satisfies the full-line length by combining a plurality of printheads as described above or the arrangement as a single printhead obtained by forming printheads integrally can be used.

In addition, not only a cartridge type printhead in which an ink tank is integrally arranged on the printhead itself but also an exchangeable chip type printhead, as described in the above embodiment, which can be electrically connected to the apparatus main unit and can receive an ink from the apparatus main unit upon being mounted on the apparatus main unit can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application Nos. 2003-377259 and 2003-377261 both filed on Nov. 6, 2003, the entire contents of which are incorporated herein by reference.

What is claimed is:

1. A printhead substrate having a plurality of first heating elements comprising:

a power supply line, connected to each of the plurality of first heating elements, for supplying a predetermined voltage;

a plurality of first wiring lines, each having a first wiring resistance, connected to the power supply line, and each of the plurality of first wiring lines being connected to one end of one of the plurality of first heating elements;

a plurality of first switching elements, each being connected to the other end of one of the plurality of first heating elements and controlling the one of the plurality of first heating elements;

a second wiring line, having a second wiring resistance, connected to the power supply line and one end of a second heating element;

a second switching element, connected to the other end of the second heating element, for controlling the second heating element;

a reference power supply which sets a reference voltage;

a comparison circuit which compares the reference voltage with a voltage based on the second wiring resistance and outputs a first signal based on the comparison; and a control circuit which inputs the first signal and outputs a second signal for controlling driving of each of the plurality of first switching elements, based on the first signal, wherein the plurality of first wiring lines and the second wiring line are formed in a same manufacturing step so that the first wiring resistance and the second wiring resistance exhibit a same characteristic.

2. The printhead substrate according to claim 1, wherein said reference power supply is a power source utilizing a band gap voltage.

3. The printhead substrate according to claim 1, wherein each of the first switching elements and the second switching element include a MOS transistor.

4. The printhead according to claim 1, wherein the second switching element is connected to an output of the comparison circuit via a switch.

* * * * *